US006030758A

United States Patent [19]

Nomiya

[11] Patent Number: 6,030,758

[45] Date of Patent: Feb. 29, 2000

[54] SILVER HALIDE LIGHT SENSITIVE PHOTOGRAPHIC MATERIAL

[75] Inventor: Makoto Nomiya, Hino, Japan

[73] Assignee: Konica Corporation, Tokyo, Japan

[21] Appl. No.: 09/133,140

[22] Filed: Aug. 12, 1998

[30] Foreign Application Priority Data

Aug. 18, 1997 [JP] Japan ..... 9-221494

[51] Int. Cl.[7] ..... G03C 7/30

[52] U.S. Cl. ..... 430/506; 430/549; 430/567; 430/569

[58] Field of Search ..... 430/549, 506, 430/567, 569

[56] References Cited

U.S. PATENT DOCUMENTS

| | | | |
|---|---|---|---|
| 4,963,465 | 10/1990 | Matejec et al. . | |
| 5,320,937 | 6/1994 | Ihama | 430/567 |
| 5,550,012 | 8/1996 | Suga | 430/567 |

FOREIGN PATENT DOCUMENTS

| | | |
|---|---|---|
| 0 107 112 | 5/1984 | European Pat. Off. . |
| 0 413 204 A2 | 2/1991 | European Pat. Off. . |
| 0 631 181 A1 | 12/1994 | European Pat. Off. . |
| 0 631 182 A1 | 12/1994 | European Pat. Off. . |

*Primary Examiner*—Janet Baxter
*Assistant Examiner*—Amanda C. Walker
*Attorney, Agent, or Firm*—Frishauf, Holtz, Goodman, Langer & Chick, P.C.

[57] ABSTRACT

A silver halide light sensitive photographic material is disclosed, comprising a support having thereon a red-sensitive silver halide emulsion layer, a green-sensitive silver halide emulsion layer and a blue-sensitive silver halide emulsion layer, wherein at least one of the red-sensitive, green-sensitive and blue-sensitive layers comprises a high-speed silver halide emulsion layer, a medium-speed silver halide emulsion layer and a low-speed silver halide emulsion layer, the low-speed layer contains a dye forming coupler having coupling reactivity higher than that of a coupler contained in the mdium speed layer.

5 Claims, No Drawings

SILVER HALIDE LIGHT SENSITIVE PHOTOGRAPHIC MATERIAL

FIELD OF THE INVENTION

The present invention relates to a silver halide light sensitive photographic material and in particular, to a silver halide light sensitive photographic material (specifically, a silver halide light sensitive color photographic material) with high sensitivity and superior graininess and improved in process stability.

BACKGROUND OF THE INVENTION

Recently, the need for the improvement of photographic performance of silver halide light sensitive photographic materials has also become severe, and further higher level requirements have also been made for photographic performance including high speed, superior graininess and improved process stability.

U.S. Pat. No. 3,726,681 discloses a technique for improving graininess, in which a coupler having a higher coupling rate is employed in a high speed emulsion layer and a coupler having a lower coupling rate is employed in a low speed emulsion layer, thereby leading to higher sensitivity and improved graininess.

JP-A 59-60437 (herein, the term, JP-A means unexamined and published Japanese Patent Application) discloses a technique for enhancing graininess and sharpness, in which a highly reactive coupler is contained in the highest speed emulsion layer and in at least one of other layers with the same spectral sensitivity is employed a lower reactive coupler and a DIR compound capable of releasing a diffusible development inhibitor or a diffusible development retarding precursor.

JP-A 2-259754 discloses a technique for improving sharpness in which among at least three emulsion layers with the same spectral sensitivity, a coupler having a lower coupling rate is employed in a medium speed layer and a DIR compound is employed in a high speed layer.

However, these techniques are insufficient in stability with respect to processing fluctuations, and further improvements are desired in terms of higher sensitivity and superior graininess.

In addition, the need for improvement of silver halide emulsions has also become marked, and further higher level requirements have also been made for photographic performance including high speed, superior graininess and improved storage stability.

There are known a variety of methods for enhancing the sensitivity of silver halide emulsions, including the method for preparing a silver halide emulsion, a chemical sensitization technique of silver halide emulsions, a spectral sensitization technique of silver halide emulsions, the method for designing a silver halide photographic material and the processing method of silver halide photographic materials. Of these, the most preferable and essential method concerns enhancement of the photographic quantum yield of silver halide grains.

The well known technique for enhancing the quantum yield in the latent image forming process of silver halide grains is employing a core having a high silver iodide content within the grain, and JP-A 63-92942 discloses a technique of providing a core with a high silver iodide content in the interior of a tabular grain. JP-A 7-92594 also discloses a technique of silver halide grains comprising a core with a high silver iodide content and a low silver iodide containing portion localized in the vicinity of the grain surface.

However, it was proved that these grains had problems such that they were fast in developing speed, resulting in deterioration of graininess.

SUMMARY OF THE INVENTION

Accordingly, it is an object of the present invention to provide a silver halide light sensitive photographic material (specifically, a silver halide light sensitive color photographic material) with high sensitivity, superior graininess and improved process stability.

The above object of the invention can be accomplished by the following constitution:

(1) a silver halide light sensitive photographic material comprising a support having thereon a red-sensitive silver halide emulsion layer, a green-sensitive silver halide emulsion layer and a blue-sensitive silver halide emulsion layer, wherein at least one of the red-sensitive, green-sensitive and blue-sensitive layers comprises a high-speed silver halide emulsion layer, a medium-speed silver halide emulsion layer and a low-speed silver halide emulsion layer, said low-speed layer contains a dye forming coupler (a) and said medium-speed layer contains a dye forming coupler (b), said coupler (a) having coupling reactivity higher than that of said coupler (b);

(2) the silver halide photographic material described in (1), wherein said high-speed layer contains a coupler having coupling reactivity higher than that of said coupler (a);

(3) the silver halide photographic material described in (1), wherein said high-speed layer contains a coupler having coupling reactivity equal to that of said coupler (a);

(4) the silver halide photographic material described in (1), wherein said high-speed layer contains a coupler having coupling reactivity which is higher than that of said coupler (b) and lower than that of said coupler (a); and (5) the silver halide photographic material descrobed in (1), wherein said high-speed layer contains a coupler having coupling reactivity which is equal to or lower than that of said coupler (b).

DETAILED DESCRIPTION OF THE INVENTION

The photographic material according to the invention comprises a support having thereon a red-sensitive silver halide emulsion layer, a green-sensitive silver halide emulsion layer and a blue-sensitive silver halide emulsion layer, and at least one of the color sensitive layers comprises three or more plural layers.

With respect to the order of coating of the red-sensitive silver halide emulsion layer, the green-sensitive silver halide emulsion layer and the blue-sensitive silver halide emulsion layer, there is specifically no limitation, and the order of the red-sensitive silver halide emulsion layer, the green-sensitive silver halide emulsion layer and the blue-sensitive silver halide emulsion layer from the support is preferred.

According to the invention, at least one color-sensitive layer (i.e., at least one of the red-sensitive, green-sensitive, and blue-sensitive layers) comprises at least three layers, and preferably, at least two color-sensitive layers each comprise at least three layers.

At least one color-sensitive layer comprises at least three layers each including a silver halide emulsion and these layers are different in sensitivity (or speed), that is, these layers are comprised of a high speed silver halide emulsion layer, a medium speed silver halide emulsion layer and a low speed silver halide emulsion layer. The sensitivity (or speed)

can be determined in accordance with the method, which will be described in Examples (item, Sensitivity Evaluation), provided that in the case of the green-sensitive and red-sensitive layers, exposure is performed through a glass filter, Y-48 which is available from TOSHIBA CORP. The difference in sensitivity between the high-speed layer and the medium-speed layer or between the medium-speed layer and the low-speed layer is not specifically limited. When the sensitivity is represented by logarithmic exposure necessary for giving a prescribed density, the sensitivity difference is preferably 0.1 to 1.0.

The layer arrangement is not specifically limited. A low speed layer, a medium speed layer and a high speed layer are preferably arranged in this order from the support. The three or more layers may be arranged directly in contact with each other, or an interlayer not containing a silver halide emulsion may be provided between the layers.

The dye image forming coupler used in the invention may be any one capable of forming a dye image. Example of preferred yellow couplers include those described in U.S. Pat. Nos. 3,933,051, 4,022,620, 4,326,024, 4,401,752 and 4,248,961; JP-B 58-10739 (herein, the term, JP-B means an examined and published Japanese Patent); British patents 1,425,020, 4,314,023 and 4,511,649; and European Patent 249,473A.

Preferred magenta couplers can include 5-pyrazolone type or pyrazoloazole type compounds. Examples thereof include those described in U.S. Pat. Nos. 3,061,432, 3,725,067, 4,310,619 and 4,351,897; European patent 73,636; Research Disclosure (hereinafter, denoted as RD) 24220 and 24230 (June, 1984); JP-A 55-118034, 60-33552, 60-35730, 60-43659, 60-185951 and 61-72238; U.S. Pat. Nos. 4,500,630, 4,540,654 and 4,556,630; and International Patent WO88/04795.

Cyan couplers usable in the invention can include known phenol type couplers and naphthol type couplers. Preferred examples thereof include those described in U.S. Pat. Nos. 4,228,233, 4,296,200, 2,369,929, 2,810,171, 2,772,162, 2,895,826, 3,772,002, 3,758,308, 4,334,011 and 4,327,173; West German Patent 3,329,729A; European Patents 121,365A and 249,453A; U.S. Pat. Nos. 3,446,622, 4,339,999, 4,775,616, 4,451,559, 4,427,767, 4,690,889, 4,254,212 and 4,296,199; and JP-A 61-42658.

There may be usable a coupler having the following function and structure. For the purpose of correcting unwanted absorption of the dye are preferably employed a coupler capable of coupling-off a fluorescent dye which corrects the unwanted absorption of a dye image, as described in U.S. Pat. No. 4,744,181 and a coupler having a dye precursor group, as a cleavage group, which is capable of forming dye upon reaction with a developing agent, as described in U.S. Pat. No. 4,777,120.

As couplers forming a dye with optimal diffusibility are preferable employed those described in U.S. Pat. No. 4,366,237, British Patent 2,125,570, European Patent 96,570 and West German Patent 3,234,533A. Examples of polymerized dye forming couplers include those described in U.S. Pat. Nos. 3,451,820, 4,080,211, 4,367,282, 4,409,320 and 4,576,910; and British Patent 2,102,173. A coupler capable of releasing a photographically useful group upon coupling can also be employed. DIR couplers capable of releasing a development inhibitor preferably include those described in JP-A 57-151944, 57-154234, 60-184248 and 63-37346; U.S. Pat. No. 4,248,962 and 4,782,012. Couplers capable of imagewise releasing nucleating agent or development accelerator preferably include those described in British Patents 2,097,140 and 2,131,188; JP-A 59-157638 and 59-170840.

Further, couplers usable in the photographic material according to the invention include a competing coupler described in U.S. Pat. No. 4,130,427; poly-equivalent coupler described in U.S. Pat. Nos. 4,283,472, 4,338,393 and 4,310,618; a DIR redox compound releasing coupler, a DIR coupler releasing coupler and a DIR coupler releasing redox compound described in JP-A 60-185950 and 62-24252; a coupler capable of releasing a dye which can be recurred after coupling-off; a bleach accelerator releasing coupler described in RD 11449 and 24241; and JP-A 61-201247; a ligand releasing coupler described in U.S. Pat. No. 4,553,477; and a leuco dye releasing coupler described in JP-A 63-75747. Furthermore, there can be employed a variety of couplers, including those described in RD 17643, VII-C through F, RD 308119, pages 1001–2, VII-D through F. Additives usable in the invention can be incorporated by the dispersing method described in RD 308119, XIV.

Relative coupling reactivity of a coupler can be determined in accordance with the kinetic competition method of J. Texter [J. Texter, J. Photogr. Sci., 36, 14 (1988)], employing competitive reaction of the coupler with citrazinic acid, which is an unballasted hydrophilic coupler.

Thus, a photographic material sample, which is prepared through dispersing a single coupler in an aqueous gelatin solution and adding the dispersion into a silver halide emulsion, is exposed and developed with a developer. From a characteristic curve of the developed sample is obtained a density difference ($\Delta D$) between a density of the minimum density (denoted as Dmin) plus 0.2 and a density obtained by exposure corresponding to 10 times the exposure giving the density of Dmin plus 0.2. Similarly, the sample is exposed and developed, provided that the developer further contains citrazinic acid of 2.0 g/l, and a density difference ($\Delta D'$) was obtained. The coupling reactivity of the coupler can be evaluated, based on the following equation:

$$t=\Delta D/\Delta D'$$

The t value is to be not less than 1.0; the closer to 1.0, the higher the coupling reactivity. In other words, the larger the t, the lower the reactivity of the coupler.

The couplers used in the invention is a dye image forming coupler which is incorporated, in a largest amount, in each of plural layers having the same color sensitivity.

According to the invention, at least one of the red-sensitive silver halide emulsion layer, green-sensitive silver halide emulsion layer and blue-sensitive silver halide emulsion layer comprises at least three high-speed layer, medium-speed layer, and low-speed layer; and coupler (a) contained in the low-speed layer is higher in the coupling reaction rate than that of coupler (b) contained in the medium-speed layer. The coupler (a) is preferably a two-equivalent coupler, and the coupler (b) is preferably four-equivalent coupler.

Silver halide grains used in the invention are not specifically limited, and so-called tabular silver halide grains are preferably used to enhance effects of the invention.

The tabular silver halide grains (hereinafter, also denoted as tabular grains) are those having two parallel major faces and a ratio of an equivalent circular diameter of the major face (i.e., a diameter of a circle having the area equivalent to the major face) to the distance between the major faces (i.e., a thickness of the grain), that is, an aspect ratio of 2 or more. In the present invention, at least 50% of the total grain projected area is accounted for preferably by tabular grains having an average aspect ratio of 5 or more, and more preferably 8 or more. The equivalent circular diameter of the tabular grains used in the invention is between 0.3 and 10 μm, preferably 0.5 and 5.0 μm, and more preferably 0.5 and 2.0 μm. The grain thickness is preferably between 0.05 and 0.8 μm. The diameter and thickness of the tabular grains can be determined in accordance with the method described in U.S. Pat. No. 4,434,226. With respect to the grain size distribution, a coefficient of variation of the equivalent circular diameter (which is a standard deviation of the diameter divided by the average diameter and times 100) is preferably not more than 30% and more preferably not more than 20%.

Halide composition of the tabular grains is preferably silver iodobromide or silver iodochlorobromide. The silver iodide content is preferably between 1 and 15 mol % and more preferably 3 and 12 mol %. With respect to the distribution of the iodide content among the tabular grains, a coefficient of variation of the silver iodide content (which is a standard deviation of the silver iodide content divided by the average silver iodide content and times 100) is preferably not more than 30% and more preferably not more than 20%.

The tabular grains used in the invention preferably contain two or more phases different in the halide composition in the interior of the grain. The silver iodide content of a phase having a maximum silver iodide content, except for the outermost layer, is preferably less than 10 mol %, more preferably not less than 5 mol % and less than 10 mol %, and still more preferably not less than 5 mol % and less than 8 mol %. This phase accounts for preferably 30 to 90%, and more preferably 30 to 60% by volume of the grain. The outermost layer is a surface layer having a thickness of 100 Å, and the interior of the grain where the maximum silver iodide containing phase is located, is internal portions of the grain, other than the outermost layer. The structure with respect to the internal halide composition of the silver halide grain can be determined by composition analysis using X-ray diffractometry or EPMA. The maximum silver iodide containing phase within the grain does not include a high iodide-localized region which is formed by operations for introducing dislocation lines.

The tabular grains can be prepared by an optimal combination of the methods known in the art, as described in JP-A 61-6643, 61-146305, 62-157024, 62-18556, 63-92942, 63-151618, 63-163451, 63-220238 and 63-311244. For example, there can be employed the double jet method, the controlled double jet method in which silver halide grains are formed under the controlled pAg and the triple jet method. There can be employed a normal precipitation method or a method of forming grains under excess silver ions (so-called reversed precipitation method). Silver halide solvents are optionally employed. Often employed as a silver halide solvent are ammonia, thioethers and thioureas. The thioethers are referred to U.S. Pat. Nos. 3,271,157, 3,790,387 and 3,574,628. There can also employed a neutral precipitation method without the use of ammonia, an ammoniacal precipitation method and an acidic precipitation method, and the pH is preferably not more than 5.5, and more preferably not more than 4.5, in terms of reduced fogging of silver halide grains.

The tabular grains used in the invention may contain iodide. The addition of the iodide during grain growth is not specifically limited, and may be performed in the form of an aqueous potassium iodide solution or in the form of fine silver iodide grains. It is preferable to form at least a part of the tabular grains using fine silver halide grains, in terms of narrowing the halide distribution among grains and reducing non-uniformity of the quantum yield in the process of latent image formation. It is more preferable to grow the tabular gains using the fine silver halide grains during the overall growth. With regard to the grain formation by the use of the fine silver halide grains, grain growth can be performed only using the fine grains, as described in JP-A 1-183417, 1-183644 and 1-183645, but the fine silver halide grains can be supplied as a source of one kind of the halide. Specifically, the iodide is supplied preferably in the form of fine silver halide grains. In cases where two or more kinds of fine silver halide grains are used in the grain growth, as described in JP-A 5-5966, at least one of the fine silver halide grains may be comprised of single halide. It is preferable to use fine silver halide grains having a solubility less than that of growing silver halide grains. As less soluble silver halide grains there are preferably used silver iodide.

The silver halide grains (e.g., tabular silver halide grains) used in the present invention preferably contains dislocation lines. The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high voltage type. From the thus-obtained electron micrograph can be determined the position and number of the dislocation lines in each grain.

With respect to the position of the dislocation lines in the tabular grains relating to the present invention, the dislocation lines exist preferably in the fringe portions of the major face. It is also preferable to exist both in the fringe portions and interior of the grain. The term, "fringe portion" refers to the peripheral portion of the major face of the tabular grain. More specifically, when a straight line is drawn outwardly from the center of gravity of the projection area projected from the major face-side, the dislocation lines exist in a region beyond 50% of the distance (L) between the intersection of a straight line with the periphery and the center, preferably, 70% or outer and more preferably 80% or outer (In other words, the dislocation lines are located in the region between 0.5 L and L outwardly from the center of each grain, preferably between 0.7 L and L, more preferably between 0.8 L and L.) The term "interior of the grain" refers to portions other than the fringe portions. With respect to the number of the dislocation lines of the tabular grains used in the invention, grains each having five or more dislocation lines account for preferably not less than 50%, and more preferably not less than 80% of the total grain projected area. The number of the dislocation lines is more preferably not less than 10. In cases when the dislocation lines exist both in the fringe portions and in the interior of the grain, five or more dislocation lines exist preferably in the interior of the grain and more preferably both in the fringe portions and in the interior.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution are added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add silver iodide fine grains or an iodide ion releasing compound, as an iodide source. It is more preferable to add silver iodide fine grains. As the iodide salt solution is preferably employed an alkali iodide aqueous solution, and as the silver salt solution is preferably employed a silver nitrate aqueous solution.

The dislocation lines are introduced preferably after formation of the maximum iodide containing phase, and more preferably after formation of the maximum iodide containing phase and before formation of the adjacent phase. With respect to the introducing position within the grain, the dislocation lines are introduced preferably between 50 and 95%, and more preferably 60 and 80% of the total silver amount of the grains.

Silver halide emulsions used in the invention can be subjected to reduction sensitization. The reduction sensitization can be performed by adding a reducing agent to a silver halide emulsion or a mixture solution used for grain growth, or by subjecting the silver halide emulsion or a mixture solution used for grain growth to ripening or grain growth, respectively, at a pAg of not more than 7 or at a pH of not less than 7. The reduction sensitization can also be performed before or after the process of chemical sensitization, as described in JP-A 7-219093 and 7-225438. Preferred reducing agents include thiourea dioxide, ascorbic acid and its derivatives and stannous salts. Examples of other reducing agents include borane compounds, hydrazine derivatives, formamidinesulfinic acid, silane compounds, amines and polyamines, and sulfites. The reducing agent is added preferably in an amount of $10^{-8}$ to $10^{-2}$ mol per mol of silver halide.

To ripen at low pAg, a silver salt may be added and aqueous soluble silver salts are preferably employed, such as silver nitrate. The pAg during ripening is not more than 7, preferably not more than 6, and more preferably between 1 and 3. To ripen at high pH, an alkaline compound may be added to a silver halide emulsion or a reaction mixture solution for grain growth. Examples of the alkaline compound include sodium hydroxide, potassium hydroxide, sodium carbonate, potassium carbonate and ammonia. In the case when adding ammoniacal silver nitrate to form silver halide, alkaline compounds other than ammonia are preferably employed.

An oxidizing agent may be added to the silver halide emulsion during the formation thereof. The oxidizing agent is a compound capable of acting on metallic silver to convert to a silver ion. The silver ion may be formed in the form of a scarcely water-soluble silver salt, such as silver halide, silver sulfide or silver selenide, or in the form of a water soluble silver salt, such as silver nitrate.

The silver halide emulsion used in the invention is subjected to sulfur sensitization or gold sensitization, and in addition selenium sensitization. Selenium sensitizers usable in the invention include selenium compounds disclosed in patents. Conventionally, adding a labile selenium compound and/or a non-labile selenium compound, the emulsion is stirred at high temperature, preferably at 40° C. or higher over a period of a given time. There are preferably employed labile selenium compounds described in JP-B 44-15748 and 43-13489 and Japanese Patent Application 2-130976 and 2-229300. Examples the labile selenium compound include isoselenocyanates (e.g., aliphatic isoselenocyanate such as allylisoselenocyanate), selenoureas, selenoketones, selenoamides, selenocarboxylic acid (e.g., 2-selenopropionic acid, 2-selenobutylic acid)selenoesters, diacylselenides [e.g., bis(3-chloro-2,6-dimethoxybenzoyl) selenide], selenophosphates, phosphineselenides and colloidal metallic selenium. The labile selenium compounds are not limited to the compounds described above.

There are employed non-labile selenium compounds described in JP-B 46-4553, 52-34492 and 52-34491. Examples of the non-labile selenium compound include selenious acid, potassium selenocyanate, selenazoles and its quaternary salts, diarylselenide, diaryl diselenide, dialkyl diselenide, 2-selenazolidinedione, 2-selenooxazolidinethione and their derivatives.

Of these selenium compounds, a compound represented by the following formula (1) or (2) is preferred.

Formula (1)

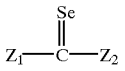

In the Formula, $Z_1$ and $Z_2$ independently represent an alkyl group (e.g., methyl, ethyl, t-butyl, adamantyl, t-octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), —N<$R_1$) ($R_2$), —$OR_3$ or —$SR_4$, in which $R_1$, $R_2$, $R_3$ and $R_4$ each represent an alkyl group, an aralkyl group, an aryl group or a heterocyclic group. The alkyl, aralkyl, aryl and heterocyclic groups are the same as defined in $Z_1$, provided that $R_1$ and $R_2$ each may be a hydrogen atom or an acyl group (e.g., acetyl, propanoyl, benzoyl, α-naphthoyl, 4-trifluoromethylbenzoyl).

In the Formula (1), $Z_1$ is preferably an alkyl group, an aryl group or —N<($R_1$) ($R_2$); $Z_2$ is preferably —N<($R_5$) ($R_6$), in which $R_1$, $R_2$, $R_5$ and $R_6$ which may be same or different, represent a hydrogen atom, an alkyl group, aryl group or acyl group.

Of the compounds represented by formula (1) are preferred N,N-dialkylselenourea, N,N,N'-trialkyl-N'-acylselenourea, tertaalkylselenourea, N,N-dialkylarylselenoamide and N-alkyl-N-aryl-N-arylselenoamide.

Formula (2)

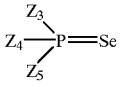

In Formula (2), $Z_3$, $Z_4$ and $Z_5$, which may be the same or different, independently an aliphatic group, an aromatic group, a heterocyclic group, —$OR_7$, —N<($R_8$) ($R_9$), $SR_{10}$, —$SeR_{11}$, X (a halogen atom) or a hydrogen atom, in which $R_7$, $R_{10}$ and $R_{11}$ represent an aliphatic group, an aromatic group, a heterocyclic group, a hydrogen atom or a cation. In Formula (2), the aliphatic group represented by $Z_3$, $Z_4$, $Z_5$, $Z_7$, $Z_8$, $Z_9$, $Z_{10}$ and $Z_{11}$ is a straight-chained, branched or cyclic alkyl group, alkenyl group, alkynyl group, aralkyl group (e.g., methyl, ethyl, propyl, isopropyl, t-butyl, butyl, octyl, decyl, hexadecyl, cyclopentyl, cyclohexyl, allyl, 2-butenyl, 3-pentenyl, propargyl, 3-pentynyl, benzyl, phenethyl). In Formula (2), the aromatic group represented by $Z_3$, $Z_4$, $Z_5$, $Z_7$, $Z_8$, $Z_9$, $Z_{10}$ and $Z_{11}$ is a monocyclic or condensed cyclic aryl group (e.g., phenyl, pentafluorophenyl, 4-chlorophenyl, 3-sulfophenyl, α-naphthyl, 4-methylphenyl). In Formula (2), the heterocyclic group represented by $Z_3$, $Z_4$, $Z_5$, $Z_7$, $Z_8$, $Z_9$, $Z_{10}$ and $Z_{11}$ is a 3 to 10-membered saturated or unsaturated heterocyclic group containing at least one of nitrogen atom, oxygen atom and sulfur atom (e.g., pyridyl, thienyl, furyl, thiazolyl, imidazolyl, benzimidazolyl).

In Formula (2), the cation represented by $R_7$, $R_{10}$ and $R_{11}$ is an alkaline metal atom or ammonium; and the halogen atom represented by X is a fluorine atom, chlorine atom, bromine atom or iodine atom. In Formula (2), $Z_3$ , $Z_4$ and $Z_5$ are preferably an aliphatic group, an aromatic group or —$OR_7$, in which $R_7$ is an aliphatic group or an aromatic group. Of the compounds represented by Formula (2) are preferred trialkylphosphine selenide, triarylphosphine selenide, trialkylselenophosphate and triarylselenophosphate.

The compounds represented by Formula (1) or (2) are exemplarily shown below, but are not limited to these examples.

Se-1

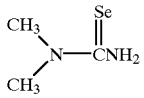

Se-2

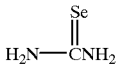

Se-3

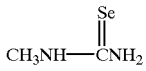

Se-4

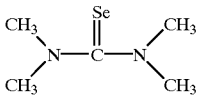

Se-5

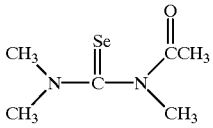

Se-6

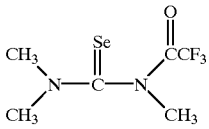

Se-7

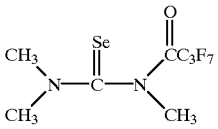

-continued

Se-8

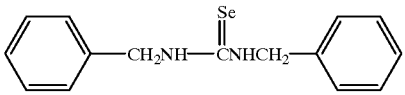

Se-9

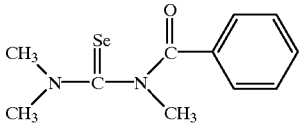

Se-10

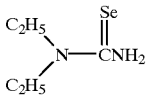

Se-11

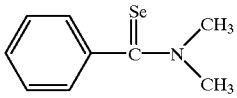

Se-12

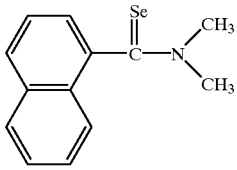

Se-13

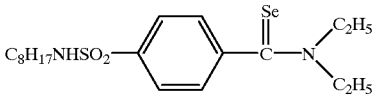

Se-14

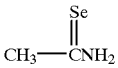

Se-15

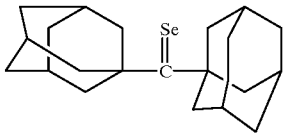

Se-16

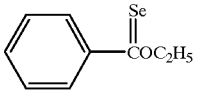

Se-17

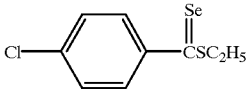

Se-18

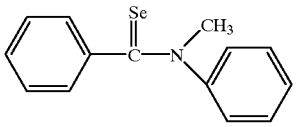

-continued
Se-19
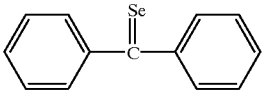
Se-20
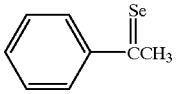
Se-21
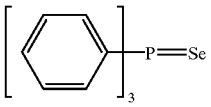
Se-22
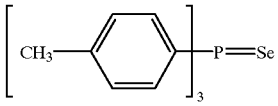
Se-23
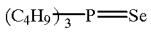
Se-24
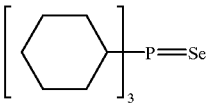
Se-25
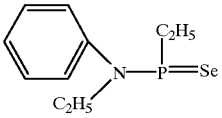
Se-26
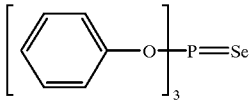
Se-27
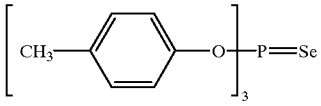
Se-28
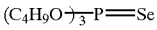
Se-29
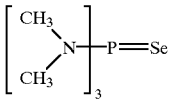
Se-30
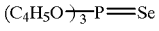
Se-31
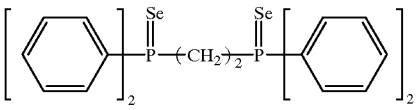
Se-32
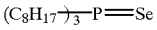
-continued
Se-33
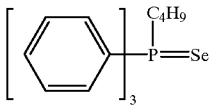
Se-34
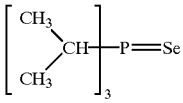
Se-35
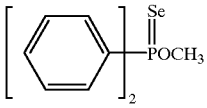
Se-36
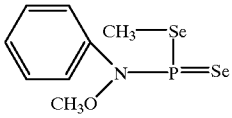
Se-37
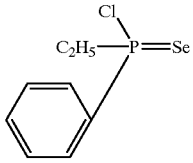
Se-38
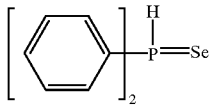
Se-39
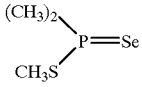
Se-40
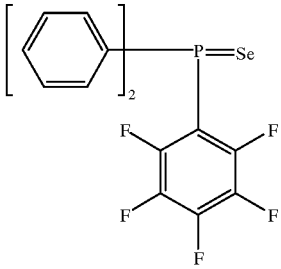
In the invention, a tellurium sensitizer can be further employed in combination. Preferred compounds are exemplarily shown below, but are not limited to these examples.
Te-1
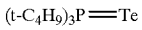
Te-2
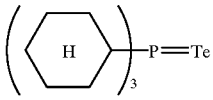

-continued
Te-3
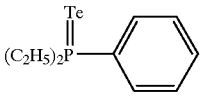
Te-4
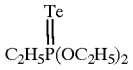
Te-5
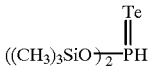
Te-6
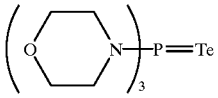
Te-7
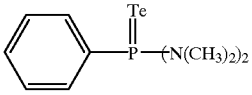
Te-8
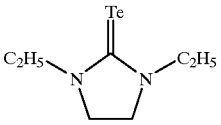
Te-9
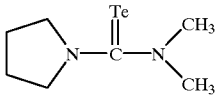
Te-10
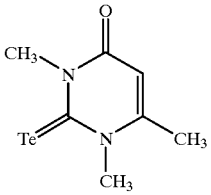
Te-11
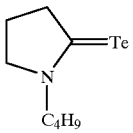
Te-12
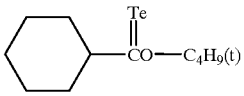
Te-13
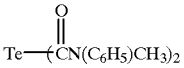
Te-14
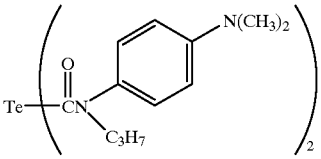
-continued
Te-15
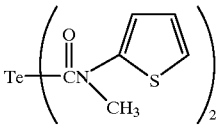
Te-16
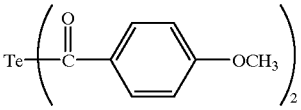
Te-17
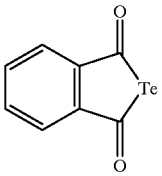
Te-18
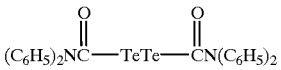
Te-19
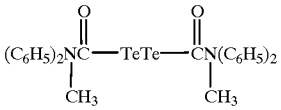
Te-20
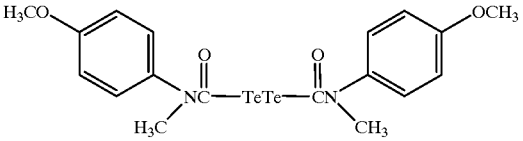
Te-21
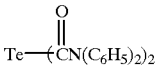
Te-22
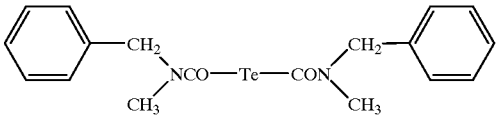
Te-23
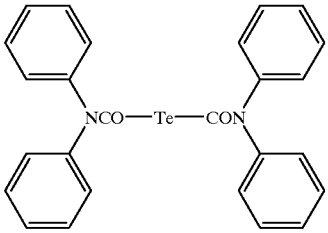
Te-24
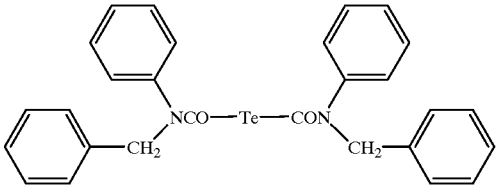
The selenium sensitizer or tellurium sensitizer can be dissolved in water or an organic solvent such as methanol or ethanol, and added at the time of chemical sensitization, in the form as described in JP-A 4-140738, 4-140742, 5-11381, 5-11385 and 5-11388. It is preferably added before starting the chemical sensitization. The selenium sensitizer or the tellurium sensitizer each are employed singly or in combination. The labile selenium compound and non-labile selenium compound can be employed in combination. A combination of one kind of the selenium sensitizer and one kind of the tellurium sensitizer can be employed. The addition amount of the selenium sensitizer or tellurium sensitizer, depending on activity of the sensitizer, the kind or the size of silver halide and ripening temperature or time, is preferably not less than $1\times10^{-8}$ mol, and more preferably between $1\times10^{-7}$ and $3\times10^{-5}$ mol per mol of silver halide. When employing the selenium sensitizer or tellurium sensitizer, the chemical ripening temperature is preferably not less than 45° C., and more preferably between 50° C. and 80° C. The pAg and pH are optional. For example, advantageous effects of the invention can be achieved within the pH range of 4 to 9. Selenium sensitization and tellurium sensitization each are effectively performed in the presence of a silver halide solvent. Examples of the silver halide solvent usable in the invention include (a) organic thioethers described in U.S. Pat. Nos. 3,271,157, 3,531,289, 3,574,628; JP-A 54-1-19, 54-158917; (b) thioureas described in JP-A 53-82408, 55-77737 and 552982; (c) silver halide solvents containing a thiocarbonyl group which is sandwiched with a oxygen or sulfur atom and a nitrogen atom described in JP-A 53-144319;(d) imidazoles described in JP-A 54-100717; (e) sulfites; and (f) thiocyanates. Of these are preferred thiocyanates and tetramethylthiourea. The amount of the solvent to be used depends on the kind thereof, and a thiocyanate, for example, is preferable between $1\times10^{-4}$ and $1\times10^{-2}$ mol per mol of silver halide.

The silver halide emulsion used in the invention can be further subjected to sulfur sensitization and/or gold sensitization to achieve high sensitivity and low fog. The sulfur sensitization can be performed by adding a sulfur sensitizer to the emulsion and stirring at high temperature, preferably at 40° C. or higher over a period of a given time. The gold sensitization can also be performed by adding a gold sensitizer to the emulsion and stirring at high temperature, preferably at 40° C. or higher over a period of a given time. In the sulfur sensitization is employed a sulfur sensitizer known in the art, including thiosulfates, thioureas, allylisothiocyanates, cystine, p-toluenethiosulfonates and rhodanines. Furthermore, there can be employed sulfur sensitizers described in U.S. Pat. Nos. 1,574,944, 2,410,689, 2,278,947, 2,728,668, 3,501,313, 3,656,955; German patent 1,422,868; JP-B 56-24937 and JP-A 55-45016. The sulfur sensitizer can be added in an amount sufficient for effectively enhancing sensitivity of the emulsion. The amount, depending on the pH, the temperature and the silver halide grain size, is preferably between $1\times10^{-7}$ and $1\times10^{-4}$ mol per mol of silver halide.

As the gold sensitizer, the oxidation number of gold may be +1 or +3, and there can be employed gold compounds conventionally used as a gold sensitizer. Examples thereof include chloroaurates, potassium chloroaurate, auric trichloride, potassium auric thiocyanate, potassium iodoaurate, tetracyanoauric acid, ammonium aurothiocyanate and pyridyltrichlorogold. The amount of the gold sensitizer to be used, depending on various conditions, is preferably between $1\times10^{-7}$ and $1\times10^{-4}$ mol per mol of silver halide.

In chemical ripening, the addition timing and order of the sulfur sensitization and/or gold sensitization which can be employed in combination with the silver solvent, selenium sensitizer or tellurium sensitizer are not specifically limited. For example, the compounds described above can be added simultaneously or separately, at the initial time of chemical ripening or during chemical ripening. The compounds can be added through solution in water or an organic solvent such as methanol, ethanol or acetone.

Further, there can be employed reduction sensitizer in combination, such as hydrazine derivatives, stannous chloride, aminoiminomethanesulfinic acid, borane compounds and polyamine compounds.

The silver halide emulsion used in the invention can contain a nitrogen containing heterocyclic compound represented by the following formula [V]:

Formula [V]

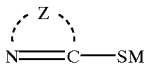

wherein Z represents an atomic group necessary for forming a 5- or 6-membered heterocyclic ring, which may be condensed with an aromatic ring or another heterocyclic ring; and M represents a hydrogen atom, an alkaline metal atom or ammonium.

The 5- or 6-membered heterocyclic ring formed by Z, which may be condensed with an aromatic ring or another heterocyclic ring, includes imidazole, triazole, tetrazole, thiazole, oxazole, selenazole, benzimidazole, naphthoimidazole, benzothiazole, naphthothiazole, benzoselenazole, pyridine, pyrimidine and quinoline. These may be substituted.

The compounds represented by Formula [V] (herein after, also denoted as compound [V]) are exemplarily shown below.

V-1

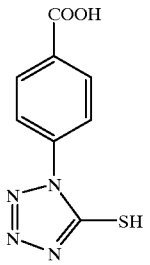

V-2

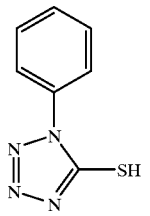

V-3

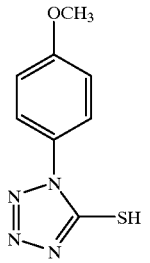

-continued

V-4

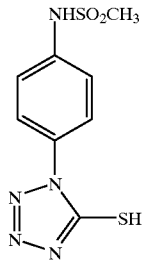

V-5

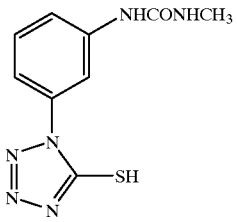

V-6

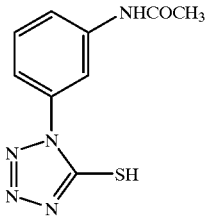

V-7

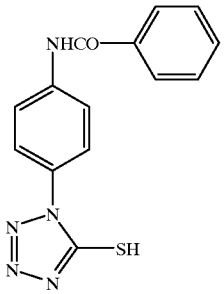

V-8

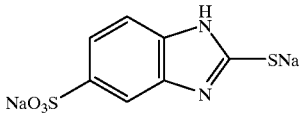

V-9

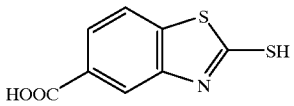

V-10

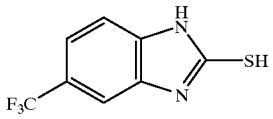

V-11

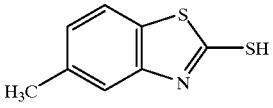

-continued

V-12

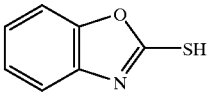

V-13

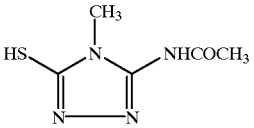

V-14

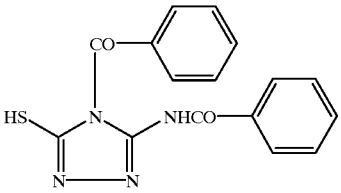

V-15

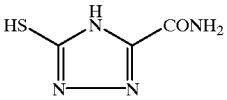

V-16

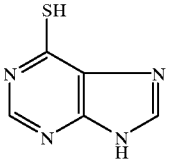

V-17

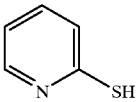

V-18

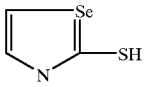

V-19

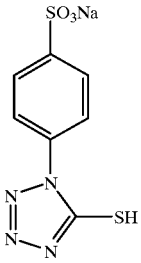

In cases where the compound [V] is allowed to be contained in a silver halide emulsion, the compound is added during chemical ripening of the emulsion, at the time of completing the chemical ripening or at a time after completion the chemical ripening and before coating. The total amount thereof may be added at a time or separately. The compound [V] is added in an amount of $1\times10^{-9}$ to $1\times10^{-1}$, and preferably $1\times10^{-7}$ to $1\times10^{-3}$ mol per mol of silver halide.

To silver halide emulsions relating to the invention are applicable techniques described in Research Disclosure No. 308119 (herein after, denoted as RD 308119), as shown below.

| Item | RD 308119 |
|---|---|
| Iodide Composition | 993, I-A |
| Preparation Method | 993, I-A, 994 E |
| Crystal Habit (Regular crystal) | 993, I-A |
| Crystal Habit (irregular crystal) | 993, I-A |
| Epitaxial | 993, I-A |
| Halide Composition (Uniform) | 993, I-B |
| Halide Composition (Non-uniform) | 993, I-B |
| Halide Conversion | 994, I-C |
| Halide Substitution | 994, I-C |
| Metal Occlusion | 994, I-D |
| Monodisperse | 995, I-F |
| Solvent Addition | 995, I-F |
| Latent Image Formation (Surface) | 995, I-G |
| Latent Image Formation (Internal) | 995, I-G |
| Photographic Material (negative) | 995, I-H |
| Photographic Material (positive) | 995, I-H |
| Emulsion Blend | 995, I-J |
| Emulsion Washing | 995, II-A |

The silver halide emulsion relating to the invention can be subjected to physical ripening, chemical ripening and spectral sensitization, according to the procedure known in the art. Additives used therein are described in RD 17643, RD 18716 and RD 308119, as shown below.

| Item | RD-308,119 | RD-17,643 | RD-18,716 |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E, J | 23–24 | 648–9 |
| Anti-Foggant | 998, IV | 24–25 | 649 |
| Stabilizer | 998, IV | 24–25 | 649 |

Photographic additives usable in the invention are also described in the above-described Research Disclosures, as shown below.

| Item | RD-308,119 | RD-17,643 | RD-18,716 |
|---|---|---|---|
| Anti-staining Agent | 1002, VII-I | 25 | 650 |
| Dye Image-Stabilizer | 1001, VII-J | 25 | |
| Whitening Agent | 998, V | 24 | |
| U.V. Absorbent | 1003, VIII-C, XIII-C | 25–26 | |
| Light Absorbent | 1003, VIII | 25–26 | |
| Light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant · Coating aid | 1005, XI | 26–27 | 650 |
| Matting Agent | 1007, XVI | | |
| Developing Agent | 1011, XXB | | |

A variety of couplers can be employed in the invention, exemplary examples thereof are described in the Research Disclosures, as shown below.

| Item | RD 308119 | RD17643 |
|---|---|---|
| Colored Coupler | 1002, VII-G | VII-G |
| DIR Coupler | 1001, VII-F | VII-F |
| BAR Coupler | 1002, VII-F | |
| PUG Releasing Coupler | 1001, VII-F | |
| Alkaline-soluble Coupler | 1001, VII-E | |

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer. as described in RD 308119 VII-K, and may have a layer arrangement, such as normal layer order, reversed layer order or unit constitution.

The present invention can be applied to a variety of color photographic materials, including a color negative film for general use or cine use, color reversal film for slide or television, color paper, color positive film, and color reversal paper.

The photographic material according to the invention may be provided with a magnetic recording layer for imputing information regarding photographic materials, such as the kind, manufacturing number, maker's name and the emulsion number; information regarding camera-photographing, such as the picture-taking date and time, aperture, exposing time, climate, picture-taking size, the kind of camera, and the use of an anamorphic lens; information necessary for printing, such as the print number, selection of filter, favorite of customers and trimming size; and information regarding customers.

The magnetic recording layer is provided on the side opposite to photographic component layers. A sublayer, an antistatic layer (conductive layer), a magnetic recording layer and a lubricating layer are preferably provided on the support in this order. As fine magnetic powder are employed metal magnetic powder, iron oxide magnetic powder, Co-doped iron oxide magnetic powder, chromium dioxide magnetic powder and barium ferrite magnetic powder. The magnetic powder can be manufactured according to the known manner.

The optical density of the magnetic recording layer is desirably as low as possible, in terms of influence on photographic images, and is preferably not more than 1.5, more preferably not more than 0.2, and still more preferably not more than 0.1. The optical density can be measured using SAKURA densitometer PDA-65 (available from Konica Corp.). Thus, using a blue light-transmitting filter, light at a wavelength of 436 nm is allowed to enter perpendicular to the coating layer and light absorption due to the coating can be determined.

The magnetic susceptibility of the magnetic recording layer is preferably not less than $3\times10^{-2}$ emu per $m^2$ of photographic material. The magnetic susceptibility can be determined using a sample-vibrating type flux meter VSM-3, available from TOEI KOGYO in such a manner that after saturating a coating sample with a given volume in the coating direction by applying an external magnetic field of 1,000 Oe, the flux density at the time of allowing the external field to be decreased to 0, is measured and converted to the volume of the magnetic layer contained in 1 $m^2$ of the photographic material. When the magnetic susceptibility per $m^2$ of the transparent magnetic layer is less than $3\times10^{-2}$ emu, there occur problems in input and output of magnetic recording.

The thickness of the magnetic recording layer is preferably between 0.01 and 20 μm, more preferably 0.05 and 15 μm, and still more preferably 0.1 and 10 μm. As a binder of the magnetic recording layer are preferably employed vinyl type resin, urethane type resin and polyester type resin. It is also preferred to form a binder by coating an aqueous emulsion resin without the use of an organic solvent. The binder can be hardened by a hardener, thermal means or electron beam to adjust physical properties. Specifically, hardening with a polyisocyanate type hardener is preferred. An abrasive can be contained in the magnetic recording layer for preventing clogging, and non-magnetic metal oxide particles, such as alumina fine particles are preferably employed.

Support of the photographic material include polyester films such as polyethylene terephthalate (PET) and polyethylene naphthalate (PEN), cellulose triacetate film, cellulose diacetate film, polycarbonate film, polystyrene film and polyolefin film. In particular, a high moisture containing polyester support is superior in recovery of roll-set curl after processing even when the support is thinned, as described in JP-A 1-24444, 1-291248, 1-298350, 2-89045, 2-93641, 2-181749, 2-214852, and 2-291135. In the invention, Pet and PEN are preferably employed as a support. The thickness thereof is preferably between 50 and 100 μm, and more preferably 60 to 90 μm.

The photographic material according to the invention preferably has a conductive layer containing a metal oxide particles, such as ZnO, $V_2O_5$, $TiO_2$, $SnO_2$, $Al_2O_3$, $In_2O_3$, $SiO_2$, MgO, BaO or $MoO_3$. The metal oxide particles containing a small amount of oxygen deficiency or a hetero atom forming a donor to the metal oxide, which is high conductive, preferably employed. Specifically, the latter, which does not provide fog to the silver halide emulsion, is preferred.

Binders used in the conductive layer or a sublayer are the same as those used in the magnetic recording layer.

As a lubricating layer provided on the magnetic recording layer is coated a higher fatty acid ester, a higher fatty acid amide, polyorganosiloxane, a liquid paraffin or a wax.

In cases where the photographic material according to the invention is employed as a roll-formed color photographic camera material, not only miniaturization of a camera or patrone is achieved, but saving of natural resource is also possible. Since storage space for a negative film is small, the width of the film is 20 to 35 mm, and preferably 20 to 30 mm. If the photographing picture area is within the range of 300 to 700 $mm^2$, preferably, 400 to 600 $mm^2$, small format becomes possible without deteriorating image quality of a final photographic print, leading to further miniaturization of patrone and camera. The aspect ratio of a photographic image area is not limited and various types are employed, such as conventional 126 size of 1:1, a half-size of 1:1.4, 135 (standard) size of 1:1.5, hi-vision type of 1:1.8 and panorama type of 1:3.

When the photographic material according to the invention is used in a roll form, it is preferably contained in a cartridge. The most popular cartridge is a 135 format patrone. There are also employed cartridges proposed in Japanese Utility Model Application Opened to Public Inspection No. 58-67329 and 58-195236; JP-A 58-181035 and 58-182634; U.S. Pat. No. 4,221,479; JP-A 1-231045, 2-170156, 2-199451, 2-124564, 2-201441, 2-205843, 2-210346, 2-2114432-214853, 2-264248, 3-37645 and 3-37646; U.S. Pat. Nos. 4,846,418, 4,848,693 and 4,832,275. It is possible ally to "small-sized photographic roll film patrone and film camera" disclosed in JP-A 5-210201.

The photographic material relating to the invention can be processed in accordance with conventional methods, as described in RD 17643 pages 28–29 and RD 18716 page 647, and RD 308119 XIX.

EXAMPLES

The present invention will now be explained based on examples, but embodiments of the present invention are not limited to these examples.

Example 1

Preparation of Seed Emulsion

A seed grain emulsion was prepared in the following manner.

To Solution A1 maintained at 35° C. and stirred with a mixing stirrer described in JP-B 58-58288 and 58-58289 were added an aqueous silver nitrate solution (1.161 mol) and an aqueous potassium bromide and potassium iodide mixture solution (containing 2 mol % potassium iodide) by the double jet method in 2 min., while keeping the silver potential at 0 mV (measured with a silver electrode and a saturated silver-silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 μm and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A | |
|---|---|
| Ossein gelatin | 24.2 g |
| Potassium bromide | 10.8 g |
| $HO(CH_2CH_2O)m(CH(CH_3)CH_2O)_{19.8}(CH_2CH_2O)_nH$ (m + n = 9.77) 10 wt. % methanol solution | 6.78 ml |
| 10% Nitric acid | 114 ml |
| $H_2O$ | 9657 ml |

Preparation of Fine Silver Iodide Grain Emulsion

The To 5 liters of a 6.0 wt.% gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 μm, and was denoted as SMC-1.

Preparation of Emulsion Em-1

700 ml of an aqueous 4.5 wt. % inert gelatin solution containing 0.178 mol equivalent of Seed Emulsion-1 and 0.5 ml of a 10% ethanol solution of $HO(CH_2CH_2O)m(CH(CH_3)CH_2O)_{19.8}(CH_2CH_2O)nH$ (m+n=9.77)

was maintained at 75° C. and after adjusting the pAg and pH to 9.6 and 5.0, respectively, a silver halide emulsion was prepared while vigorously stirring, according to the following procedure.

1) An aqueous silver nitrate solution of 0.692 mol, SMC-1 of 0.297 mol and an aqueous potassium bromide solution were added by the double jet method while keeping the pAg and pH were maintained at 9.6 and 5.0, respectively.

2) Subsequently, an aqueous silver nitrate solution of 2.295 mol, SMC-1 of 0.071 mol and an aqueous potassium bromide solution were added by the double jet method while keeping the pAg and pH were maintained at 9.6 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 1.00 μm, average aspect ratio of 5.7 and the halide composition as shown in Table 1. From electron microscopic observation, it was proved that this emulsion contained no grains having dislocation lines.

Preparation of Emulsion Em-2

700 ml of an aqueous 4.5 wt. % inert gelatin solution containing 0.178 mol equivalent of Seed Emulsion-1 and 0.5 ml of a 10% ethanol solution of $HO(CH_2CH_2O)m(CH(CH_3)CH_2O)_{19.8}(CH_2CH_2O)nH$ (m+n=9.77)

was maintained at 75° C. and after adjusting the pAg and pH to 8.3 and 5.0, respectively, a silver halide emulsion was prepared while vigorously stirring, according to the following procedure.

1) An aqueous silver nitrate solution of 2.1 mol. SMC-1 of 0.195 mol and an aqueous potassium bromide solution were added by the double jet method while keeping the pAg and pH were maintained at 8.9 and 5.0, respectively (formation of host grains).

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.92 mol, SMC-1 of 0.069 mol and an aqueous potassium bromide solution were added by the double jet method while keeping the pAg and pH were maintained at 9.8 and 5.0, respectively (shelling of host grains).

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 1.00 μm, average aspect ratio of 7.0 and the halide composition as shown in Table 1. From electron microscopic observation, it was proved that at least 60% of the total grain projected area was accounted for by grains having 5 or more dislocation lines both in fringe portions and in the interior of the grain.

Preparation of Emulsion Em-3

700 ml of an aqueous 4.5 wt. % inert gelatin solution containing 0.178 mol equivalent of Seed Emulsion-1 and 0.5 ml of a 10% ethanol solution of polyisoprene-polyethyleneoxy-disuccinic acid ester sodium salt, was maintained at 75° C. and after adjusting the pAg and pH to 9.6 and 5.0, respectively, a silver halide emulsion was prepared while vigorously stirring, according to the following procedure.

1) An aqueous silver nitrate solution of 0.692 mol, SMC-1 of 0.297 mol and an aqueous potassium bromide solution were added by the double jet method while keeping the pAg and pH were maintained at 8.9 and 5.0, respectively.

2) Subsequently, an aqueous silver nitrate solution of 2.295 mol, SMC-1 of 0.071 mol and an aqueous potassium bromide solution were added by the double jet method while keeping the pAg and pH were maintained at 8.9 and 5.0, respectively.

3) After completing the step 2), SMC-1 of 0.004 mol was added thereto and ripened for 15 min.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.65 μm, average aspect ratio of 4.3 and the halide composition as shown in Table 1. From electron microscopic observation, it was proved that this emulsion contained no grains having dislocation lines. The silver iodide content of the surface was 12.0 mol %.

Preparation of Emulsion Em-4

700 ml of an aqueous 4.5 wt. % inert gelatin solution containing 0.178 mol equivalent of Seed Emulsion-1 and 0.5 ml of a 10% ethanol solution of $HO(CH_2CH_2O)m(CH(CH_3)CH_2O)_{19.8}(CH_2CH_2O)nH$ (m+n=9.77)

was maintained at 75° C. and after adjusting the pAg and pH to 8.3 and 5.0, respectively, a silver halide emulsion was prepared while vigorously stirring, according to the following procedure.

1) An aqueous silver nitrate solution of 2.1 mol, SMC-1 of 0.195 mol and an aqueous potassium bromide solution were added by the double jet method while keeping the pAg and pH were maintained at 8.9 and 5.0, respectively (formation of host grains).

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.65 μm, average aspect ratio of 7.0 and the halide composition as shown in Table 1. From electron microscopic observation, it was proved that at least 60% of the total grain projected area was accounted for by grains having 5 or more dislocation lines both in fringe portions and in the interior of the grain. The silver iodide content of the surface was 6.7 mol %.

In Table 1 are shown the silver iodide content of the internal layers of the grains of each of Emulsions Em-1 through Em-4, average aspect ratio and the presence of dislocation lines.

TABLE 1

| Em No. | AgI content [1)] | Aspect ratio [2)] | Dislocation line |
|---|---|---|---|
| Em-1 | 2/30/3 | 5.7 | No. |
| Em-2 | 2/8.5/X/7 | 7.0 | Yes |
| Em-3 | 2/30/3 | 4.3 | No. |
| Em-4 | 2/8.5/X/3 | 7.0 | Yes |

[1)] Iodide content (mol %) of each phase, in which X indicates a dislocation lines introducing position.
[2)] An aspect ratio at 50% of the sum of the total projected area of silver halide grains of each emulsion.

Emulsions A-1 through A-7 and B-1 through B-7 were prepared in the following manner.

Preparation of Emulsions A-1 and A-2

To each of the emulsions Em-1 and Em-2 were added at 55° C. SD-1 of $3.0\times10^{-5}$ mol/mol Ag, SD-2 of $1.5\times10^{-4}$ mol/mol Ag, SD-3 of $3.0\times10^{-4}$ mol/mol Ag; then, sodium thiosulfate of $6.0\times10^{-6}$ mol/mol Ag, chloroauric acid of $1.7\times10^{-6}$ mol/mol Ag and potassium thiocyanate of $3.1\times10^{-4}$ mol/mol Ag were further added thereto and ripened over an optimal period of time. After completion of ripening, 4-hydroxy-6-methyl-1,3,3a,7-tetraazaindene, as a stabilizer was added to obtain emulsions A-1 and A-2, respectively.

Preparation of Emulsion A-3

To emulsions Em-2 were added at 55° C. SD-1 of $3.0\times10^{-5}$ mol/mol Ag, SD-2 of $1.5\times10^{-4}$ mol/mol Ag, SD-3 of $3.0\times10^{-4}$ mol/mol Ag; then sodium thiosulfate of $6.0\times10^{-6}$ mol/mol Ag, a selenium sensitizer (se-21) of $1.0\times10^{-6}$ mol/mol Ag, chloroauric acid of $1.77\times10^{-6}$ mol/mol Ag and potassium thiocyanate of $3.1\times10^{-4}$ mol/mol Ag were further added thereto and ripened over an optimal period of time. After completion of ripening, 4-hydroxy-6-methyl-1,3,3a,7-tetraazaindene, as a stabilizer was added to obtain emulsions A-3.

Preparation of Emulsions A-4 and A-6

To each of the emulsions Em-3 and Em-4 were added at 55° C. SD-1 of $5.0\times10^{-5}$ mol/mol Ag, SD-2 of $2.0\times10^{-4}$ mol/mol Ag, SD-3 of $3.0\times10^{-4}$ mol/mol Ag; then, sodium thiosulfate of $8.0\times10^{-6}$ mol/mol Ag, chloroauric acid of $2.0\times10^{-6}$ mol/mol Ag and potassium thiocyanate of $3.1\times10^{-4}$ mol/mol Ag were further added thereto and ripened over an optimal period of time. After completion of ripening, 4-hydroxy-6-methyl-1,3,3a,7-tetraazaindene, as a stabilizer was added to obtain emulsions A-4 and A-6, respectively.

Preparation of Emulsions A-5 and A-7

To each of the emulsions Em-3 and Em-4 were added at 55° C. SD-1 of $5.0\times10^{-5}$ mol/mol Ag, SD-2 of $2.0\times10^{-4}$ mol/mol Ag, SD-3 of $3.0\times10^{-4}$ mol/mol Ag; then, sodium thiosulfate of $8.0\times10^{-6}$ mol/mol Ag, a selenium sensitizer (Se-21) of $1.0\times10^{-6}$ mol/mol Ag, chloroauric acid of $2.0\times10^{-6}$ mol/mol Ag and potassium thiocyanate of $3.1\times10^{-4}$ mol/mol Ag were further added thereto and ripened over an optimal period of time. After completion of ripening, 4-hydroxy-6-methyl-1,3,3a,7-tetraazaindene, as a stabilizer was added to obtain emulsions A-5 and A-7, respectively.

Preparation of Emulsions B-1 through B-3

Emulsions B-1 through B-3 were prepared in the same manner as emulsions A-1 through A-3, respectively, except that SD-1, SD-2 and SD-3 were replaced by SD-6 of $4.0\times10^{-4}$ mol/mol Ag, SD-7 of $8.0\times10^{-5}$ mol/mol Ag and SD-8 of $5.0\times10^{-5}$ mol/mol Ag.

Preparation of Emulsions B-4 through B-7

Emulsions B-4 through B-7 were prepared in the same manner as emulsions A-4 through A-7, respectively, except that SD-1, SD-2 and SD-3 were replaced by SD-6 of $5.0\times10^{-4}$ mol/mol Ag, SD-7 of $1.0\times10^{-4}$ mol/mol Ag and SD-8 of $6.0\times10^{-5}$ mol/mol Ag.

Characteristics of emulsion A-1 through A-7 and B-1 through B-7 are summarized in Table 2.

TABLE 2

| Emulsion | Em No. | Spectral sensitivity | Selenium sensitization | Grain diameter (μm) |
|---|---|---|---|---|
| A-1 | Em-1 | Red* | No | 1.0 |
| A-2 | Em-2 | Red* | No | 1.0 |
| A-3 | Em-2 | Red* | Yes | 1.0 |
| A-4 | Em-3 | Red* | No | 0.65 |
| A-5 | Em-3 | Red* | Yes | 0.65 |
| A-6 | Em-4 | Red* | No | 0.65 |
| A-7 | Em-4 | Red* | Yes | 0.65 |
| B-1 | Em-1 | Green* | No | 1.0 |
| B-2 | Em-2 | Green* | No | 1.0 |
| B-3 | Em-2 | Green* | Yes | 1.0 |
| B-4 | Em-3 | Green* | No | 0.65 |
| B-5 | Em-3 | Green* | Yes | 0.65 |
| B-6 | Em-4 | Green* | No | 0.65 |
| B-7 | Em-4 | Green* | Yes | 0.65 |

*Red: Red-sensitivity
Green: Green-sensitivity

Example 2

The following layers having the composition described below were coated on a cellulose triacetate film support in this order from the support to prepare a multi-layered color photographic material Sample 101. The addition amount was expressed in g per $m^2$, unless otherwise noted. The coating amount of silver halide or colloidal silver was converted to silver. With respect to a sensitizing dye (denoted as SD), it was expressed in mol per mol of silver halide contained in the same layer.

| | |
|---|---|
| 1st layer (Antihalation layer) | |
| Black colloidal silver | 0.16 |
| UV-1 | 0.30 |
| CM-1 | 0.044 |
| OIL-1 | 0.044 |
| Gelatin | 1.33 |
| 2nd layer (Interlayer) | |
| AS-1 | 0.160 |
| OIL-1 | 0.20 |
| Gelatin | 1.40 |
| 3rd layer (Low speed red-sensitive layer) | |
| Silver iodobromide emulsion a | 0.12 |
| Silver iodobromide emulsion b | 0.50 |
| SD-1 | $3.0\times10^{-5}$ |
| SD-2 | $1.5\times10^{-4}$ |
| SD-3 | $3.0\times10^{-4}$ |
| SD-4 | $3.0\times10^{-6}$ |

-continued

| | |
|---|---|
| C-1 | 0.51 |
| CC-1 | 0.047 |
| OIL-2 | 0.45 |
| AS-2 | 0.005 |
| Gelatin | 1.40 |
| 4th layer (Medium speed red-sensitive layer) | |
| Emulsion A-4 | 0.64 |
| C-1 | 0.22 |
| CC-1 | 0.028 |
| DI-1 | 0.002 |
| OIL-2 | 0.21 |
| AS-3 | 0.006 |
| Gelatin | 0.87 |
| 5th layer (High speed red-sensitive layer) | |
| Emulsion A-1 | 1.20 |
| C-1 | 0.17 |
| CC-1 | 0.029 |
| DI-1 | 0.027 |
| OIL-2 | 0.23 |
| AS-3 | 0.013 |
| Gelatin | 1.23 |
| 6th layer (Interlayer) | |
| OIL-1 | 0.29 |
| AS-1 | 0.23 |
| Gelatin | 1.00 |
| 7th layer (Low speed green-sensitive layer) | |
| Silver iodobromide emulsion a | 0.245 |
| Silver iodobromide emulsion b | 0.105 |
| SD-4 | $5.0 \times 10^{-4}$ |
| SD-5 | $5.0 \times 10^{-4}$ |
| M-1 | 0.21 |
| CM-2 | 0.039 |
| OIL-1 | 0.25 |
| AS-2 | 0.003 |
| AS-4 | 0.063 |
| Gelatin | 0.98 |
| 8th layer (Interlayer) | |
| M-1 | 0.03 |
| CM-2 | 0.005 |
| OIL-1 | 0.16 |
| AS-1 | 0.11 |
| Gelatin | 0.80 |
| 9th layer (Medium speed green-sensitive layer) | |
| Emulsion B-4 | 0.87 |
| M-1 | 0.17 |
| CM-2 | 0.048 |
| CM-3 | 0.059 |
| DI-2 | 0.012 |
| OIL-1 | 0.29 |
| AS-4 | 0.05 |
| AS-2 | 0.005 |
| Gelatin | 1.43 |
| 10th layer (High speed green-sensitive layer) | |
| Emulsion B-1 | 1.19 |
| M-1 | 0.09 |
| CM-3 | 0.020 |
| DI-3 | 0.005 |
| OIL-1 | 0.11 |
| As-4 | 0.026 |
| AS-5 | 0.014 |
| As-6 | 0.006 |
| Gelatin | 0.78 |
| 11th layer (Yellow filter layer) | |
| Yellow colloidal silver | 0.05 |
| OIL-1 | 0.18 |
| AS-7 | 0.16 |
| Gelatin | 1.00 |
| 12th layer (Low speed blue-sensitive layer) | |
| Silver iodobromide emulsion g | 0.29 |
| Silver iodobromide emulsion h | 0.19 |

-continued

| | |
|---|---|
| SD-9 | $8.0 \times 10^{-4}$ |
| SD-10 | $3.1 \times 10^{-4}$ |
| Y-1 | 0.91 |
| DI-4 | 0.022 |
| OIL-1 | 0.37 |
| AS-2 | 0.002 |
| Gelatin | 1.29 |
| 13th layer (High speed blue-sensitive layer) | |
| Silver iodobromide emuision h | 0.13 |
| Silver iodobromide emuision i | 1.00 |
| SD-9 | $4.4 \times 10^{-4}$ |
| SD-10 | $1.5 \times 10^{-4}$ |
| Y-1 | 0.48 |
| DI-4 | 0.019 |
| OIL-1 | 0.21 |
| As-2 | 0.004 |
| Gelatin | 1.55 |
| 14th layer (First protective layer) | |
| Silver iodobromide emulsion J | 0.30 |
| UV-1 | 0.055 |
| UV-2 | 0.110 |
| OIL-2 | 0.63 |
| Gelatin | 1.32 |
| 15th layer (Second protective layer) | |
| PM-1 | 0.15 |
| PM-2 | 0.04 |
| WAX-1 | 0.02 |
| D-1 | 0.001 |
| Gelatin | 0.55 |

Characteristics of silver iodobromide emulsions described above are summarized below.

| Emulsion No. | Av. grain diameter ($\mu$m) | Av. AGI content (mol %) | Diameter/Thickness ratio |
|---|---|---|---|
| a | 0.30 | 2.0 | 1.0 |
| b | 0.40 | 8.0 | 1.4 |
| g | 0.40 | 2.0 | 4.0 |
| h | 0.65 | 8.0 | 1.4 |
| i | 1.00 | 8.0 | 2.0 |
| j | 0.05 | 2.0 | 1.0 |

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

The structure of compounds used in the Sample is as follows.
C-1
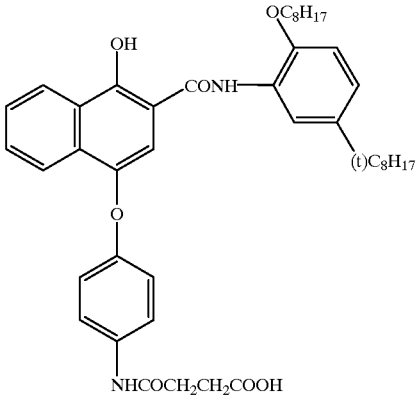
M-1
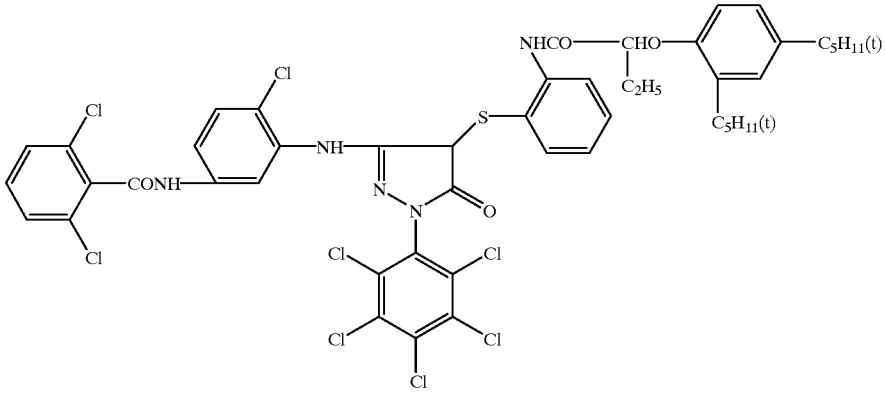
Y-1
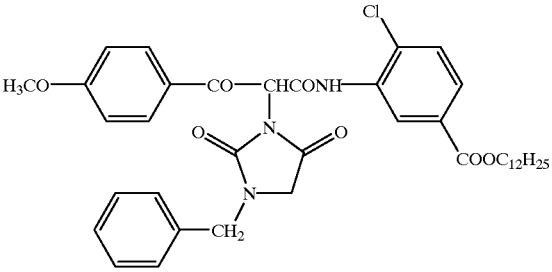
CC-1
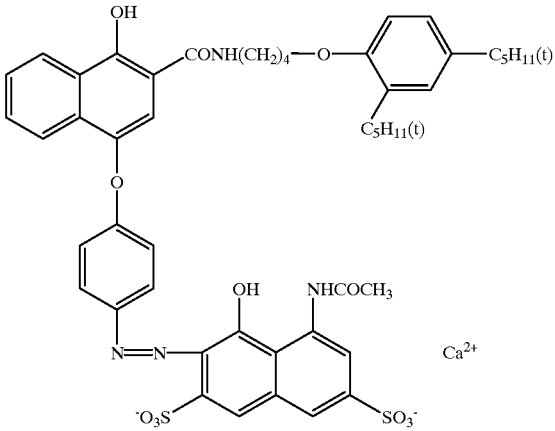

-continued
CM-1
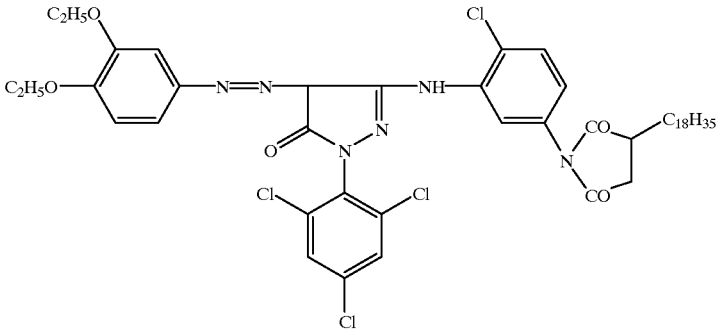
CM-2
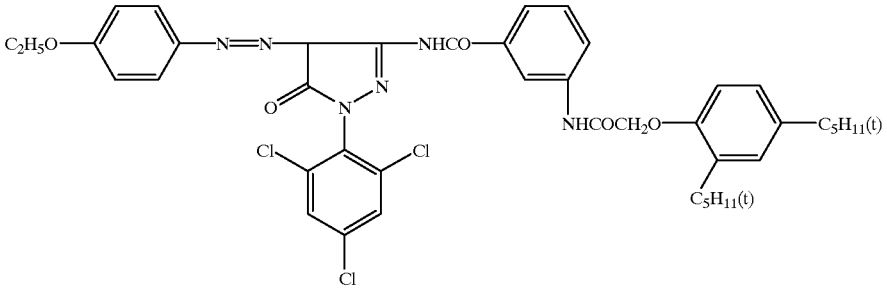
CM-3
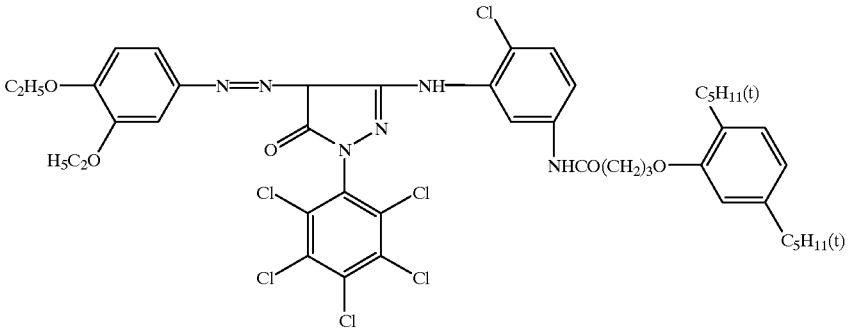
DI-1
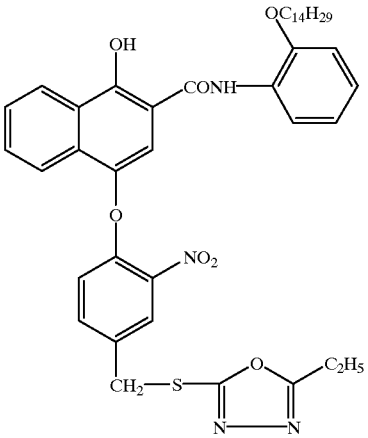

-continued
DI-2
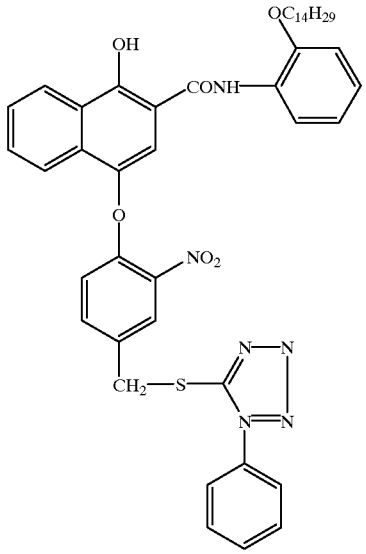
DI-3
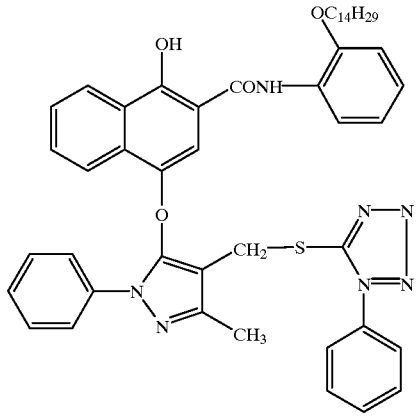
DI-4
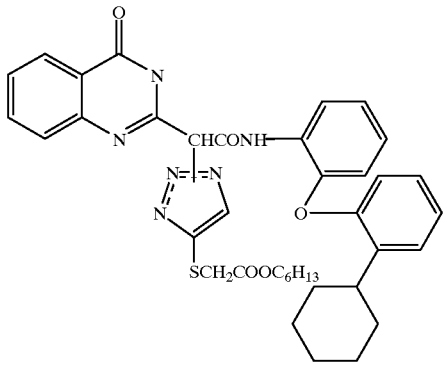
AS-1
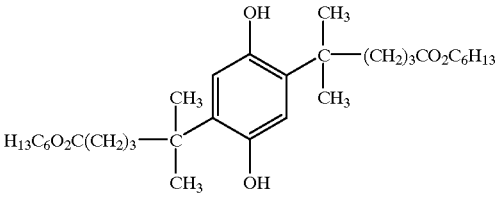

-continued
AS-2
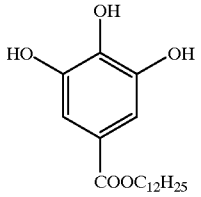
AS-3
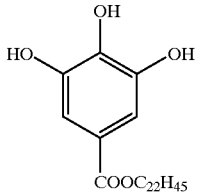
AS-4
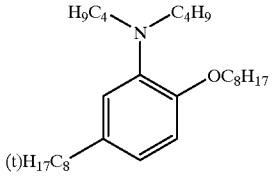
AS-5
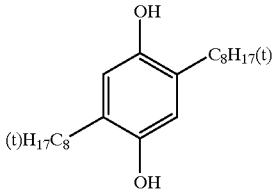
AS-6
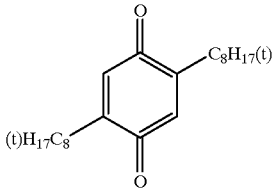
AS-7
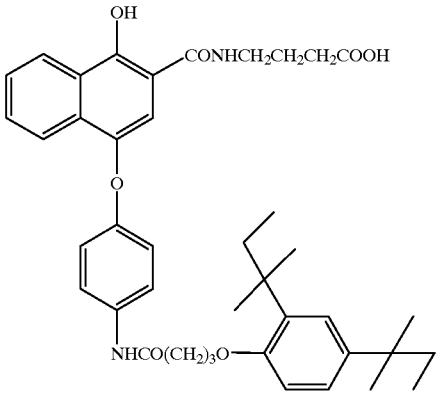

-continued
SD-1
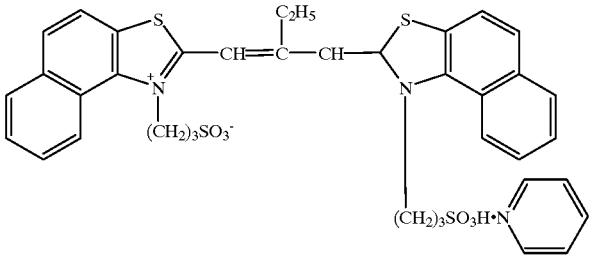
SD-2
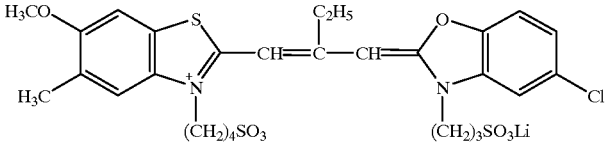
SD-3
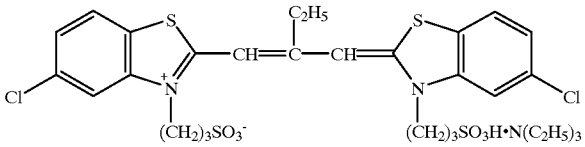
SD-4
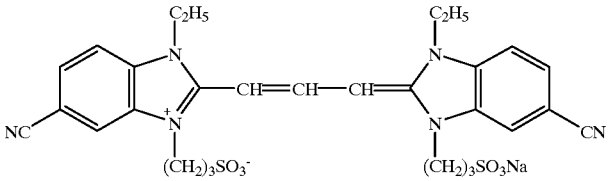
SD-5
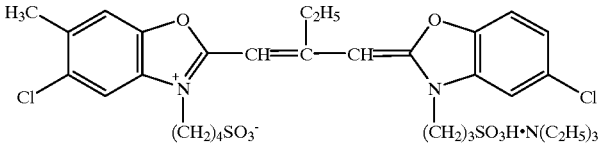
SD-6
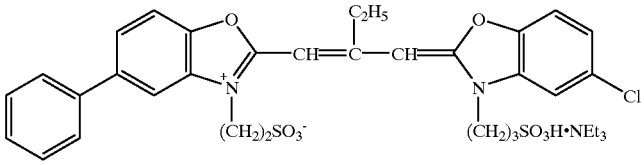
SD-7
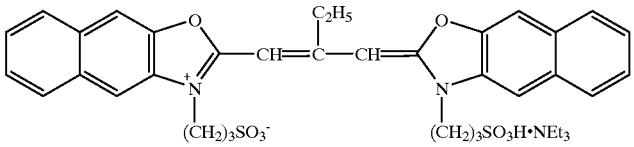
SD-8
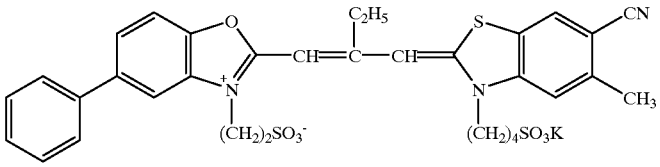

-continued
SD-9
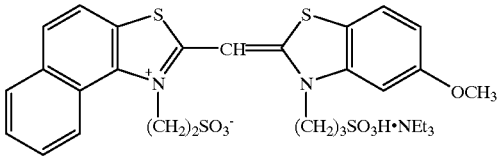
SD-10
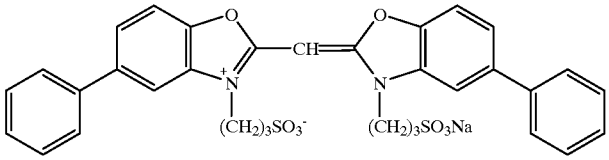
ST-1
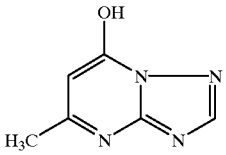
ST-2
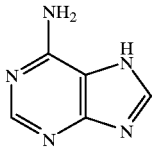
AF-1,2
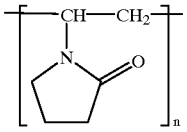
AF-1 Mw = 10,000
AF-2 Mw = 1,100,000
n:Polymerization degree
AF-3
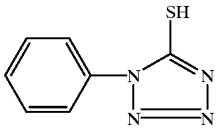
AF-4
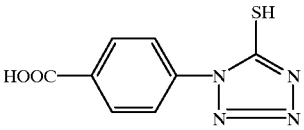
AF-5
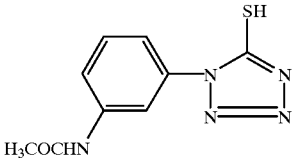
SU-1
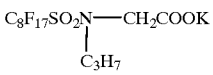
SU-2
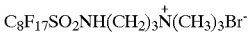

-continued
SU-3
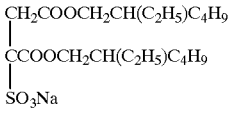
SU-4
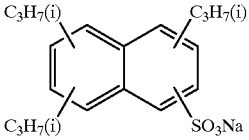
WAX-1
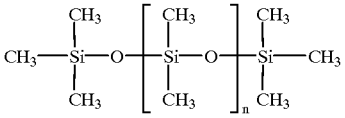
Mw = 3,000
D-1
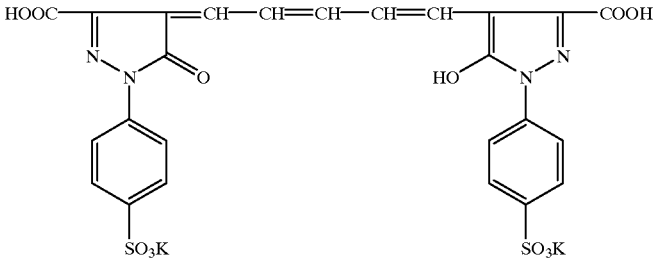
PM-1
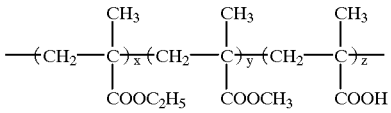
x:y:z = 3:3:4
PM-2
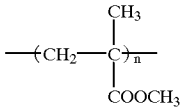
n:Polymerization degree
OIL-1
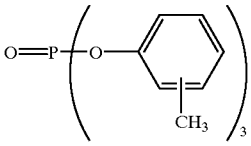
OIL-2
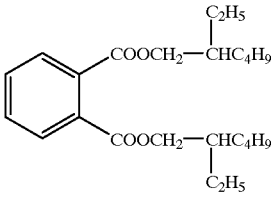
UV-1
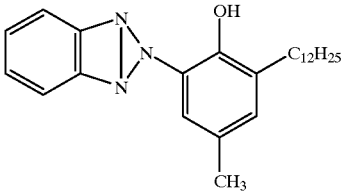

-continued

UV-2

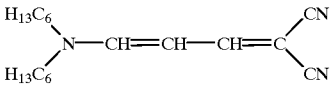

V-1

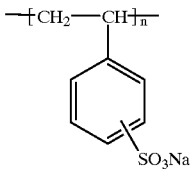

n:Polymerization degree

Ase-1 (Mixture of components A, B and C)

(A)

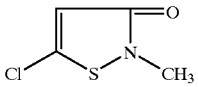

(B)

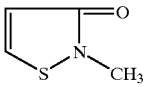

(C)

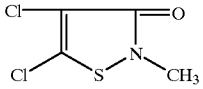

A:B:C = 50:46:4 (molar ratio)

H-1

$[(CH_2{=}CH{-}SO_2CH_2)_3{-}C{-}CH_2{-}SO_2CH_2CH_2]_2{-}NCH_2CH_2SO_3K$

H-2

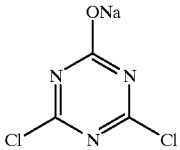

Thus, multi-layered color photographic material Sample 101 was prepared.

Evaluation of Coupler Reactivity

Reactivity of each coupler, C-1 through C-3 and M-1 through M-5 was evaluated according to the method of J. Texter afore-described. Reactivities of C-2 and C-3 were each shown as a relative value, based on C-1, and those of M-2 through M-5 were shown as a relative value, based on M-1.

Thus, Couplers M-1 to M-5, each was dissolved in a mixture of ethyl acetate and high boiling solvent (OIL-1). Couplers C-1 to C-3, each was dissolved in a mixture of ethyl acetate and high boiling solvent (OIL-2). Each coupler solution was dispersed in an aqueous gelatin solution and further thereto were added a silver emulsion and photographic additives such as a coating aid and a hardener to prepare a coating solution. The thus prepared coating solution was coated on a triacetyl cellulose film and dried in a conventional manner to obtain a single emulsion layer sample.

Each sample was exposed and processed according to the process as described later. From a characteristic curve of each processed sample was obtained a density difference (ΔD) between a density of Dmin plus 0.2 and a density obtained by exposure which corresponded to 10 times the exposure giving the density of Dmin plus 0.2. Similarly, the sample was exposed and processed, provided that the sample was developed with a developer containing citrazinic acid of 2.0 g/l; and a density difference (ΔD') was obtained and the ratio (t) of ΔD/ΔD' was determined. Further, the ratio, t=ΔD/66 D' of each sample was determined. As described above, the ratio with regard to C-2 and C-3 is shown as a relative value, based on that of C-1; and the ratio with regard to M-2 through M-5 is shown as a relative value, based on that of M-1, provided that the developing time was 2 min. 40 sec.

TABLE 3

| Coupler | t (rel. value) |
|---|---|
| M-1 | 1.00 |
| M-2 | 1.15 |
| M-3 | 1.19 |
| M-4 | 1.07 |
| M-5 | 1.60 |

TABLE 4
| Coupler | t (rel. value) |
|---|---|
| C-1 | 1.00 |
| C-2 | 1.29 |
| C-3 | 1.32 |
C-2
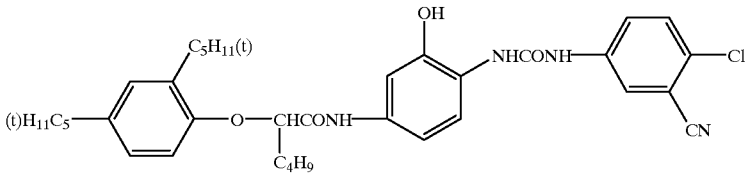
C-3
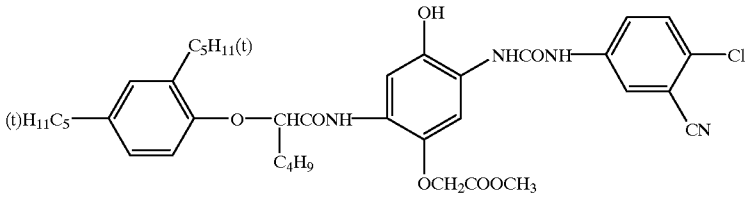
M-2
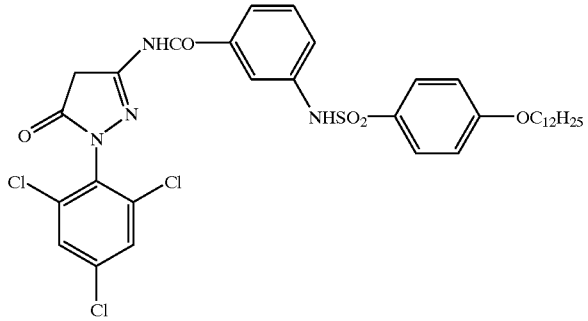
M-3
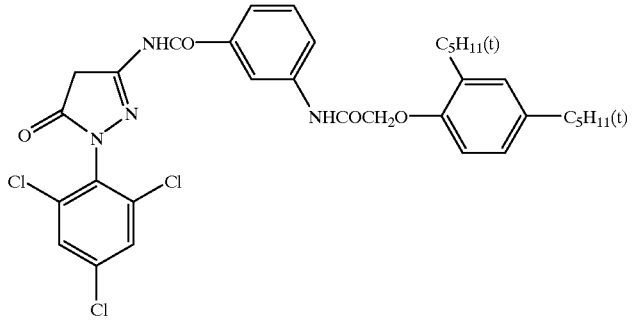

-continued

M-4

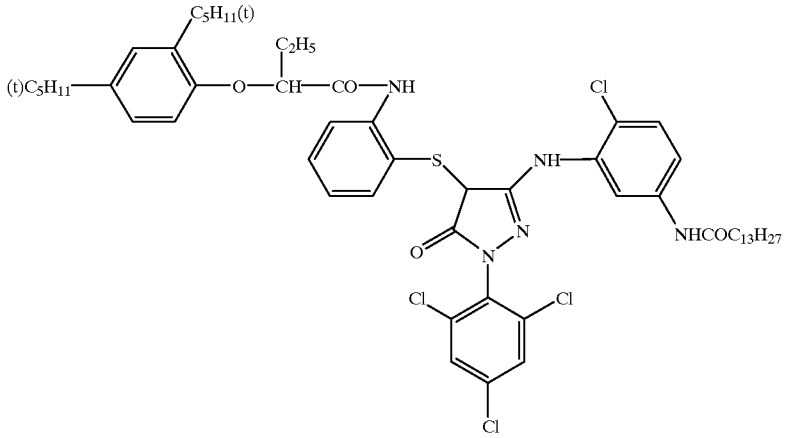

M-5

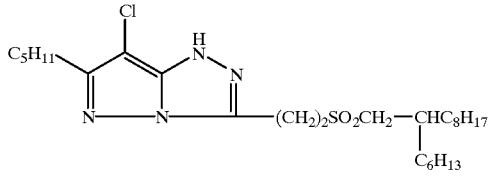

In the Table, it means that the more the value of t, the slower the reactivity

Next, Samples 102 through 121 were prepared in a manner similar to Sample 101, provided that a cyan coupler (C-1) and emulsion (A-1) used in the 5th layer, a cyan coupler (C-1) and emulsion (A-4) used in the 4th layer, and a cyan coupler (C-1) used in the 3rd layer were replaced as shown in Table 5. Further, Samples 202 through 221 were prepared in a manner similar to Sample 101, provided that a magenta coupler (M-1) and emulsion (B-i) used in the 10th layer, a magenta coupler (M-1) and emulsion (B-4) used in the 9th layer, and a magenta coupler (M-1) used in the 7th layer were replaced as shown in Table 6. When the coupler used in Sample 101 was replaced in Sample 202 through 221, the coupler amount was adjusted so that the maximum densities of the 3rd, 4th and 5th layers and maximum densities of the 7th, 9th and 10th layers of each sample were respectively identical to those of the 3rd, 4th and 5th layers and those of the 7th, 9th and 10th layers of Sample 101.

Evaluation of Photographic Performance

Samples 101 through 121 and 202 through 221 were each subjected to exposure and processing, and evaluated in accordance with the following procedure.

Sensitivity:

Each sample was exposed to white light through an optical wedge and processed according to the process described below. From characteristic curves of cyan dye images and magenta dye images, the sensitivity was defined as reciprocal of exposure necessary for giving a density of the minimum density plus 0.3. With regard to Samples 101 through 121, the sensitivity of the red-sensitive layer of each sample was shown as a relative value, based on the sensitivity of Sample 101 being 100. With regard to Samples 101 and 202 through 121, the sensitivity of the green-sensitive layer of each sample was shown as a relative value, based on the sensitivity of Sample 101 being 100. Results thereof are shown in Tables 5 and 6.

Graininess:

Graininess was evaluated with respect to cyan dye images of Sample 101 through 121 and magenta dye images of Sample 101 and 202 through 221. Thus, dye image portions having a density of Dmin plus 0.5 were scanned with a microdensitometer with an aperture of 250 $\mu$m2 and a standard deviation of density variation was determined. Standard deviations of cyan images of Sample 101 through 121 were shown as a relative value, based on the standard deviation of Sample 101 being 100. Similarly, standard deviations of magenta images of Sample 101 and 202 through 221 were shown as a relative value, based on the standard deviation of Sample 101 being 100. Results thereof are shown in Tables 5 and 6. The less this value, the superior graininess.

Process stability:

Samples 101 through 121 and 202 through 221 were each exposed to white light and processed by changes of the developing time from 2 min. 45 sec. to 3 min. 15 sec. or 3 min. 45 sec. From characteristic curves of cyan images of Sample 101 through 121 and magenta images of Sample 101 and 202 through 221, variation of sensitivity with changes of the developing time was determined. Thus, sensitivity was defined as reciprocal of exposure necessary for giving a density of a fog density plus 0.3 or a density of a fog density plus 1.3. Sensitivities were shown as relative values, based on the sensitivity at the developing time of 3 min. 15 sec. being 100, and denoted as $A_{(+0.3,2'45")}$, $A_{(+0.3,3'45")}$, $A_{(+1.3,2'45")}$ and $A_{(+1.3,3'45")}$.

| Processing: | | | Replenishing |
|---|---|---|---|
| Processing step | Time | Temperature | rate* |
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 60 sec. | 55 ± 5.0° C. | — |

*: Amounts per $m^2$ of photographic material

Preparation of Processing Solutions

Color developer:

| | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-(β-hydroxyethyl)aniline sulfate | 4.5 g |
| Diethylenetriaminepentaacetic acid | 3.0 g |
| Potassium hydroxide | 1.2 g |

Water was added to make 1 liter in total, and the pH was adjusted to 10.06 with potassium hydroxide and sulfuric acid.

Color developer (replenisher):

| | |
|---|---|
| Water | 800 ml |
| Potassium carbonate | 35 g |
| Sodium hydrogencarbonate | 3.0 g |
| Potassium sulfite | 5.0 g |
| Sodium bromide | 0.4 g |
| Hydroxylamine sulfate | 3.1 g |
| 4-Amino-3-methyl-N-(β-hydroxyethyl)-aniline sulfate | 6.3 g |
| Diethylenetriaminepentaacetic acid | 3.0 g |
| Potassium hydroxide | 2.0 g |

Water was added to make 1 liter in total, and the pH was adjusted to 10.18 with potassium hydroxide and sulfuric acid.

Bleach:

| | |
|---|---|
| Water | 700 ml |
| Ammonium iron (III) 1,3-diaminopropanetetraacetic acid | 12.5 g |
| Ethylenediaminetetraacetic acid | 2 g |
| Sodium nitrate | 40 g |
| Ammonium bromide | 150 g |
| Glacial acetic acid | 40 g |

Water was added to make 1 liter in total and the pH was adjusted to 4.4 with ammoniacal water or glacial acetic acid.

Bleach (replenisher):

| | |
|---|---|
| Water | 700 ml |
| Ammonium iron (III) 1,3-diaminopropanetetraacetic acid | 175 g |
| Ethylenediaminetetraacetic acid | 2 g |
| Sodium nitrate | 50 g |
| Ammonium bromide | 200 g |
| Glacial acetic acid | 56 g |

Water was added to make 1 liter in total and the pH was adjusted to 4.0 with ammoniacal water or glacial acetic acid.

Fixer:

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 liter in total and the pH was adjusted to 6.2 with ammoniacal water or glacial acetic acid.

Fixer (replenisher):

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Water was added to make 1 liter in total and the pH was adjusted to 6.5 with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Results are shown in Tables 5 and 6.

TABLE 5

| Sample No. | 5th layer Cyan Coupler | 4th layer Cyan Coupler | 3rd layer Cyan Coupler | 5th layer Emulsion | 4th layer Emulsion | Red-sensitive layer (3, 4, 5th layer): Cyan Image Sensitivity | Granularity | Process Stability $A_{(+0.3,\ 2'35")}$ | $A_{(+0.3,\ 3"55")}$ | $A_{(+1.3,\ 2'35")}$ | $A_{(+1.3,\ 3'55")}$ | Remark |
|---|---|---|---|---|---|---|---|---|---|---|---|---|
| 101 | C-1 | C-1 | C-1 | A-1 | A-4 | 100 | 100 | 75 | 120 | 50 | 145 | Comp. |
| 102 | C-1 | C-2 | C-3 | A-1 | A-4 | 100 | 98 | 75 | 120 | 48 | 143 | Comp. |
| 103 | C-3 | C-2 | C-1 | A-1 | A-4 | 100 | 88 | 78 | 118 | 55 | 133 | Inv. |

TABLE 5-continued

| Sample No. | 5th layer Cyan Coupler | 4th layer Cyan Coupler | 3rd layer Cyan Coupler | 5th layer Emulsion | 4th layer Emulsion | Red-sensitive layer (3, 4, 5th layer): Cyan Image Sensitivity | Granularity | Process Stability $A_{(+0.3,\ 2'35")}$ | $A_{(+0.3,\ 3"55")}$ | $A_{(+1.3,\ 2'35")}$ | $A_{(+1.3,\ 3'55")}$ | Remark |
|---|---|---|---|---|---|---|---|---|---|---|---|---|
| 104 | C-3 | C-3 | C-2 | A-1 | A-4 | 100 | 88 | 78 | 118 | 56 | 134 | Inv. |
| 105 | C-3 | C-2 | C-1 | A-2 | A-6 | 112 | 90 | 81 | 116 | 60 | 126 | Inv. |
| 106 | C-3 | C-2 | C-1 | A-3 | A-6 | 119 | 92 | 83 | 114 | 62 | 127 | Inv. |
| 107 | C-3 | C-2 | C-1 | A-3 | A-7 | 120 | 91 | 84 | 113 | 65 | 119 | Inv. |
| 108 | C-2 | C-2 | C-1 | A-3 | A-4 | 121 | 90 | 84 | 112 | 65 | 123 | Inv. |
| 109 | C-3 | C-2 | C-1 | A-3 | A-5 | 118 | 91 | 83 | 112 | 65 | 120 | Inv. |
| 110 | C-2 | C-3 | C-1 | A-1 | A-4 | 100 | 88 | 78 | 117 | 54 | 136 | Inv. |
| 111 | C-2 | C-3 | C-1 | A-2 | A-6 | 113 | 90 | 81 | 115 | 59 | 129 | Inv. |
| 112 | C-2 | C-3 | C-1 | A-3 | A-7 | 121 | 90 | 84 | 112 | 64 | 122 | Inv. |
| 113 | C-2 | C-3 | C-1 | A-3 | A-5 | 119 | 90 | 84 | 112 | 65 | 121 | Inv. |
| 114 | C-1 | C-3 | C-2 | A-1 | A-4 | 100 | 89 | 80 | 116 | 54 | 138 | Inv. |
| 115 | C-1 | C-3 | C-2 | A-2 | A-6 | 117 | 91 | 83 | 114 | 59 | 131 | Inv. |
| 116 | C-1 | C-3 | C-2 | A-3 | A-7 | 124 | 92 | 86 | 111 | 64 | 124 | Inv. |
| 117 | C-1 | C-3 | C-2 | A-3 | A-5 | 122 | 92 | 85 | 111 | 64 | 122 | Inv. |
| 118 | C-1 | C-2 | C-1 | A-1 | A-4 | 100 | 90 | 80 | 116 | 55 | 137 | Inv. |
| 119 | C-1 | C-2 | C-1 | A-2 | A-6 | 118 | 92 | 83 | 114 | 60 | 130 | Inv. |
| 120 | C-1 | C-2 | C-1 | A-3 | A-7 | 125 | 91 | 86 | 111 | 65 | 123 | Inv. |
| 121 | C-1 | C-2 | C-1 | A-3 | A-5 | 123 | 92 | 85 | 111 | 65 | 122 | Inv. |

TABLE 6

| Sample No. | 10th layer Magenta Coupler | 9th layer Magenta Coupler | 7rd layer Magenta Coupler | 10th layer Emulsion | 9th layer Emulsion | Green-sensitive layer (7, 9, 10th layer): Magenta Image Sensitivity | Granularity | Process Stability $A_{(+0.3,\ 2'35")}$ | $A_{(+0.3,\ 3"55")}$ | $A_{(+1.3,\ 2'35")}$ | $A_{(+1.3,\ 3'55")}$ | Remark |
|---|---|---|---|---|---|---|---|---|---|---|---|---|
| 101 | M-1 | M-1 | M-1 | B-1 | B-4 | 100 | 100 | 78 | 121 | 55 | 147 | Comp. |
| 202 | M-1 | M-2 | M-3 | B-1 | B-4 | 100 | 98 | 78 | 121 | 53 | 145 | Comp. |
| 203 | M-3 | M-2 | M-1 | B-1 | B-4 | 100 | 87 | 81 | 119 | 60 | 135 | Inv. |
| 204 | M-5 | M-5 | M-1 | B-1 | B-4 | 100 | 86 | 81 | 119 | 61 | 136 | Inv. |
| 205 | M-3 | M-2 | M-1 | B-2 | B-6 | 110 | 89 | 84 | 117 | 65 | 128 | Inv. |
| 206 | M-3 | M-2 | M-1 | B-3 | B-7 | 119 | 91 | 87 | 114 | 70 | 121 | Inv. |
| 207 | M-3 | M-2 | M-1 | B-3 | B-4 | 116 | 90 | 87 | 113 | 70 | 125 | Inv. |
| 208 | M-3 | M-2 | M-1 | B-3 | B-5 | 117 | 90 | 86 | 113 | 70 | 122 | Inv. |
| 209 | M-2 | M-3 | M-1 | B-1 | B-4 | 100 | 87 | 81 | 118 | 59 | 138 | Inv. |
| 210 | M-4 | M-3 | M-1 | B-2 | B-6 | 115 | 89 | 84 | 116 | 64 | 131 | Inv. |
| 211 | M-2 | M-3 | M-1 | B-3 | B-7 | 122 | 91 | 87 | 113 | 69 | 124 | Inv. |
| 212 | M-2 | M-3 | M-1 | B-3 | B-5 | 120 | 90 | 87 | 113 | 70 | 123 | Inv. |
| 213 | M-1 | M-3 | M-2 | B-1 | B-4 | 100 | 88 | 83 | 117 | 59 | 140 | Inv. |
| 214 | M-1 | M-5 | M-3 | B-2 | B-6 | 116 | 89 | 86 | 115 | 64 | 133 | Inv. |
| 215 | M-1 | M-3 | M-2 | B-3 | B-7 | 123 | 91 | 89 | 112 | 69 | 126 | Inv. |
| 216 | M-1 | M-3 | M-2 | B-3 | B-5 | 121 | 92 | 88 | 112 | 69 | 124 | Inv. |
| 217 | M-1 | M-2 | M-1 | B-1 | B-4 | 100 | 88 | 83 | 117 | 60 | 139 | Inv. |
| 218 | M-1 | M-2 | M-1 | B-2 | B-6 | 117 | 90 | 86 | 115 | 65 | 132 | Inv. |
| 219 | M-1 | M-3 | M-1 | B-3 | B-6 | 118 | 90 | 86 | 115 | 67 | 129 | Inv. |
| 220 | M-1 | M-3 | M-1 | B-3 | B-7 | 119 | 92 | 89 | 112 | 70 | 125 | Inv. |
| 221 | M-1 | M-3 | M-1 | B-3 | B-5 | 110 | 92 | 88 | 112 | 70 | 124 | Inv. |

As can be seen from Tables 5 and 6, inventive samples achieved higher sensitivity and superior graininess and process stability. Specifically, samples in which an emulsion containing silver halide grains having two or more phases different in the silver iodide content and dislocation lines, or a selenium-sensitized emulsion was employed, achieved still higher sensitivity and superior process stability.

What is claimed is:

1. A silver halide light sensitive photographic material comprising a support having thereon a red-sensitive silver halide emulsion layer, a green-sensitive silver halide emulsion layer and a blue-sensitive silver halide emulsion layer, wherein at least one of the red-sensitive, green-sensitive and blue-sensitive layers comprises a high-speed silver halide emulsion layer, a medium-speed silver halide emulsion layer and a low-speed silver halide emulsion layer, said low-speed layer contains a dye forming coupler (a) and said medium-speed layer contains a dye forming coupler (b), said coupler (a) having coupling reactivity higher than that of said coupler (b), wherein said high-speed layer contains a coupler having coupling reactivity which is equal to or lower than that of said coupler (b).

2. The silver halide photographic material of claim 1, wherein said coupler (a) is a two-equivalent coupler, and said coupler (b) being four-equivalent coupler.

3. The silver halide photographic material of claim 1, wherein at least one of the high-speed layer, medium-speed layer and low-speed layer contains silver halide grains, at least 50% of the total projected area of the silver halide grains contained being accounted for by tabular grains having an aspect ratio of 2 or more.

4. The silver halide photographic material of claim 3, wherein said tabular grains each contains two or more silver halide phases having different silver iodide contents, among which a highest iodide containing phase contains silver iodide of not less than 5 mol % and less than 10 mol %, and said tabular grains each having 10 or more dislocation lines.

5. The silver halide photographic material of claim 3, wherein said tabular grains have been subjected to selenium sensitization.

* * * * *